US007210260B1

(12) United States Patent
Smalley, Jr. et al.

(10) Patent No.: US 7,210,260 B1
(45) Date of Patent: May 1, 2007

(54) FIREARM CARTRIDGE AND CASE-LESS CHAMBER

(75) Inventors: Robert B. Smalley, Jr., 230 Skyline Dr., Brigham City, UT (US) 84302; Michael McPherson, Cortez, CO (US)

(73) Assignee: Robert B. Smalley, Jr., Brigham City, UT (US)

( * ) Notice: Subject to any disclaimer, the term of this patent is extended or adjusted under 35 U.S.C. 154(b) by 0 days.

(21) Appl. No.: 11/416,147

(22) Filed: May 2, 2006

Related U.S. Application Data

(60) Division of application No. 10/757,773, filed on Jan. 15, 2004, now Pat. No. 7,086,336, which is a continuation-in-part of application No. 10/307,821, filed on Dec. 2, 2002, now abandoned, which is a continuation of application No. 09/946,127, filed on Sep. 4, 2001, now Pat. No. 6,523,475.

(60) Provisional application No. 60/236,233, filed on Sep. 28, 2000.

(51) Int. Cl.
*F42B 5/26* (2006.01)
*F42B 5/18* (2006.01)
*F41A 21/00* (2006.01)

(52) U.S. Cl. ..... 42/76.01; 102/431; 102/464; 89/14.05

(58) Field of Classification Search ..... 102/430–444, 102/464–469; 42/76.01, 77; 89/14.05, 29
See application file for complete search history.

(56) References Cited

U.S. PATENT DOCUMENTS

| | | | |
|---|---|---|---|
| 214,680 | A | 4/1879 | Merriam |
| 1,316,786 | A | 9/1919 | Gerle et al. |
| 2,455,080 | A | 11/1948 | Miller et al. |
| 2,926,612 | A | 3/1960 | Olin |
| 3,048,105 | A | 8/1962 | Schlatter |

(Continued)

FOREIGN PATENT DOCUMENTS

| | | |
|---|---|---|
| DE | 750320 | 1/1945 |

(Continued)

OTHER PUBLICATIONS

Frank C. Barnes: Cartridges of the World 9th Edition, Revised and Expanded; pp. 1-3; pp. 157 and 206.

(Continued)

*Primary Examiner*—James S. Bergin
(74) *Attorney, Agent, or Firm*—Madson & Austin

(57) ABSTRACT

A firearm cartridge has a case configured with a relatively straight-walled portion and a shoulder portion for housing a quantity of propellant. The case further includes a neck for retaining a bullet. The straight-walled portion defines a base cavity having an interior base diameter. The interior base diameter is approximately twice or more the neck diameter. The diameter ratios of the base and neck optimize combustion efficiency to reduce heat and acceleration losses. The cartridge body cavity is sized and configured to contain a sufficient quantity of propellant such that igniting the propellant causes formation of a propellant plug having a diameter that is approximately the diameter of the bullet, and wherein the propellant plug shears free from unburned propellant that is disposed adjacent the relatively straight-walled body portion.

4 Claims, 19 Drawing Sheets

U.S. PATENT DOCUMENTS

| | | | | |
|---|---|---|---|---|
| 3,209,691 | A | 10/1965 | Herter | |
| 3,527,137 | A | 9/1970 | Scanlon | |
| 3,696,749 | A | 10/1972 | Scanlon | |
| 3,832,951 | A | 9/1974 | Katz et al. | |
| 5,463,956 | A | 11/1995 | Harting | |
| 5,463,959 | A | 11/1995 | Kramer | |
| 5,481,978 | A | 1/1996 | Muller et al. | |
| 5,767,221 | A | 6/1998 | Poulter et al. | |
| 5,826,361 | A | 10/1998 | Jamison | |
| 5,834,673 | A | 11/1998 | Gustavsson et al. | |
| 5,970,879 | A | 10/1999 | Jamison | |
| 6,293,203 | B1 | 9/2001 | Alexander et al. | |
| 6,354,221 | B1 | 3/2002 | Jamison | |
| 6,523,475 | B2 | 2/2003 | Smalley, Jr. et al. | |
| 6,532,876 | B1 | 3/2003 | Ramirez et al. | |
| 6,550,174 | B2 | 4/2003 | Jamison | |
| 6,595,138 | B2 | 7/2003 | Jamison | |
| 6,675,717 | B2 | 1/2004 | Jamison | |
| 6,679,150 | B1 | 1/2004 | Ramirez et al. | |
| 6,832,556 | B1 | 12/2004 | Smalley, Jr. | |
| 7,086,336 | B2 * | 8/2006 | Smalley et al. | 102/430 |
| 2004/0074412 | A1 | 4/2004 | Kightlinger | |
| 2006/0248773 | A1 * | 11/2006 | Kightlinger | 42/77 |

FOREIGN PATENT DOCUMENTS

| | | |
|---|---|---|
| GB | 14678 | 9/1890 |
| GB | 11747 | 5/1896 |
| GB | 2557 | 12/1903 |
| GB | 2154713 | 9/1985 |
| GB | 2164426 | 3/1986 |

OTHER PUBLICATIONS

Jon R. Sundra; Remington's .300 Ultra Mag; Petersen's Rifle Shooter, Feb. 1999; pp. 44-47.
Stanton L. Wormley, Jr.; Weatherb; American Rifleman, Oct. 1997; pp. 1-5.
Roy L. Towers, Jr.; The 6mm Remington Improved; Precision Shooting, Sep. 1998; pp. 78-83.
James Patric; Shooting The 25 Souper Improved; Precision Shooting, May 1998; pp. 35-42.
Todd A. Kindler; The 20 TNT a Dynamite Varmint Cartridge; Precision Shooting, Apr. 1998; pp. 1-3.
M.L. McPherson; Sometimes Bigger is Better: Lazzeroni Arms; Precision Shooting, Mar. 1998; pp. 7-15.
M.L. McPherson; Fireforming, It Ain't All That Simple; Precision Shooting, Feb. 1998; pp. 29-35.
Bob Jourdan; An Adventure with the .17 Caliber; Precision Shooting, Feb. 1998; pp. 41-50.
Todd A. Kindler; 6 Vartag Turbo; Precision Shooting, Nov. 1997; pp. 82-84.
Bob Greenleaf; Bob Greenleaf on Very Accurate Cartridges; Precision Shooting Special 5, vol. 1—1997; pp. 24.
Bob Jourdan; The Ackley 6MM REM and .22-250; Precision Shooting, Jun. 1997; pp. 69-75.
Mike Winkler; The 6MM HLS; Precision Shooting, May 1997; pp. 21-21-32.
Ron Jeter; TP (Turbulence Point) Wildcat Cartridges for Top Performance The Quest for Perfection; Precision Shooting, May 1997; pp. 83-87.
George Reynolds; Small Cartridges Stuff; Precision Shooting Special 4, vol. 1—1997; pp. 37.
Dave Scott; Identifying the Well-Behaved Rifle; Precision Shooting, Special 4, vol. 1—1997; pp. 38-39.
Bob Jourdan; Muses on Case Capacity (Again); Precision Shooting, Special 4, vol. 1—1997; pp. 76-77.
Steve Hanson; My Trio of 6MM Varmint Rifles, 6MM Remington, 6MM Ackley Improved, 6,/284; Precision Shooting, Nov. 1999; pp. 72-77.
Jon R. Sundra; Custom Short 7 Mag, A Guided Tour Through the Process of Putting Together a Project Rifle That's Customized Just for You; Petersen's Rifle Shooter, Aug. 2000, pp. 50-55.
Scott E. Mayer; The All-new Hard-Hitting, Beltless .376 Steyr Cartridge Offers Ballistics Approaching Those of the .375 H & H Mag. in a Compact Package; American Rifleman, Mar. 2000; pp. 38-41.
Ian Cheeseman; A 6.5 Wildcat and a Small Piece of White Card; Precision Shooting, Jan. 1997; pp. 92-97.
Roger Johnston and Pat Gamman; More on the Little 6MM BR With 105/107 Grain Bullets; Precision Shooting, Jan. 1997; pp. 32-37.
Todd A. Kindler; The Twenty is Back! and Here to Stay; Precision Shooting, Jan. 1997; pp. 12-16.
Roy L. Towers, Jr.; Building and Shooting a 22-250 Ackley Improved; Precision Shooting, Feb. 1997; pp. 79-84.
Randolph Constantine; Case-Forming Made Easier; Precision Shooting, Feb. 2000; pp. 64-70.
Bob Jourdan; The .256 Newton; Precision Shooting, March 2000; pp. 78-87.
M.L. McPherson; Bringing the Short, Fat Case to 1000 Yard Competition; Precision Shooting, Aug. 1999, pp. 26-28.
Ben Peal; the 6X33 JRP; Precision Shooting, May 1999; pp. 1-6.
M.L. McPherson; The Conservation Theory of Case Design; Precision Shooting, Jan. 1999; pp. 50-51.
Gary Hardison; The Tale of Grumpy and the 6MM-06; The Varmint Hunter Magazine, Issue #27, Jul. 1998; pp. 223.
Mark Harris; My Custom .280 Ackley; The varmint Hunter Magazine, Issue #27, Jul. 1998; pp. 211-212.
Wayne van Zwoll; Worthwhile Wildcats; Petersen's Rifle Shooter, Apr. 1999; pp. 42-46.
M.L. McPherson, et al., "SMC: Introducing A New Era", The Varmint Hunter Magazine, Issue #42, Apr. 2002, pp. 81-91.
Robert B. Smalley, "A New Look at Cartridge Internal Ballistics," Precision Shooting, May 2002, pp. 34-43.
M.L. McPherson, "More Dope on the SMC Cartridge Line," The Varmint Hunter Magazine, Issue 44, Oct. 2002, pp. 78-79.
M.L. McPherson, "Primers, Powder, & Plume Penetration Part 1, Smokeless," Single Shot Rifle Journal, May-Jun. 2003, pp. 42-56.
M.L. McPherson, "Primers, Powder 7 Plume Penetration Part 2, Black Powder," Single Shot Rifle Journal, Jul.-Aug. 2003, pp. 42-56.
M.L. McPherson, "How Far Does A Primer Plume Penetrate?," The Varmint Hunter Magazine, Issue 49, Jan. 2004, pp. 101-110.
Getting to the Botton of the Lott, Readers Write, American Rifleman, Mar. 2004, pp. 8.

* cited by examiner

FIREARM CARTRIDGE AND CASE-LESS CHAMBER

CROSS-REFERENCE TO RELATED APPLICATIONS

This is a divisional of U.S. application Ser. No. 10/757,773, filed Jan. 15, 2004 U.S. Pat. No. 7,086,335, which is a continuation-in-part of U.S. application Ser. No. 10/307,821, filed Dec. 2, 2002 now abandoned, which is a continuation of U.S. application Ser. No. 09/946,127, filed Sep. 4, 2001, U.S. Pat. No. 6,523,475, which claims the benefit of U.S. Provisional Application No. 60/236,233, filed Sep. 28, 2000, which are hereby incorporated by reference.

BACKGROUND OF THE INVENTION

The invention is directed to cartridges and corresponding chambers for use with firearms of various sizes, and preferably with rifles and long guns having a barrel length greater than about 18 inches.

Firearm technology has advanced from the early muzzle-loader wherein black powder and projectiles where separately loaded into the muzzle of a firearm barrel. Modern firearms use a cartridge which includes a case, housing a propellant, a primer, and a projectile. Cartridges have greatly reduced the frequency of misfires that were commonly experienced with case-less ammunition. For rifle and handgun ammunition the case is typically but not necessarily metallic, such as brass, aluminum or steel. A case may or may not utilize a shoulder disposed below a case neck. The case neck retains a projectile. Configured with a shoulder, the case body may have a larger interior diameter than the projectile. For shotgun ammunition, the case is typically paper or plastic with a metal head and is called a shell. The primer is the ignition component which is affixed to the case in a manner to be in communication with the propellant through a flash hole. The primer includes pyrotechnic material such as metallic fulminate or lead styphnate and may be located within the center base of the case or on a rim. Larger cartridges may utilize a "spit tube" extending along the centerline of the case as an ignition aid.

The rear portion of a firearm barrel includes a chamber which is designed to receive the cartridge. The firearm includes a firing mechanism that drives a firing pin or an electrical charge to ignite the pyrotechnic material in the primer. A combustion process is initiated within the cartridge when the primer ignites. Hot high-pressure gases and particulates are produced by ignition of the primer pyrotechnic. The gases exit through a flash hole or holes into the case, which contains the propellant and trapped air. The propellant is typically a combustible powder having various configurations of granules or grains. The propellant and entrained air not ignited by the primer-blast is compressed into a solid mass having the characteristics of a very viscous fluid having excellent compressive strength but little shear strength.

Firearm cartridges are divided into two basic types, straight-walled and bottlenecked, which are distinct in shape and function. Straight-walled cases are so named because they have a cylindrical or slightly tapered shape with an inside diameter equal to or slightly greater than the projectile diameter. Bottlenecked or shouldered cases are so named because they taper from a base to a frusto-conical shoulder and neck which holds the projectile.

The straight-walled and bottlenecked cartridge shapes have distinctly different combustion characteristics and efficiencies. In the straight-walled case, propellant that was not initially ignited by the primer, burns from the aft, or flash hole, end forward with most of the propellant following the projectile into the barrel bore. The propellant along the case wall, although sheared away from the case wall by projectile movement, may not ignite because the case wall has up to 400 times the thermal conductivity of the propellant. This has the effect of cooling and quenching ignition at the case wall in addition to causing significant heat loss to the cartridge case and gun chamber.

Acceleration losses are high and powder burn rates must be very fast to minimize such losses. Any propellant not consumed before the projectile leaves the muzzle will be expelled and cannot contribute to projectile acceleration. Heat losses caused by burning propellant in the barrel are very high.

The bottlenecked or shouldered case is somewhat more efficient. As propellant is ignited at the primer flash hole or holes, a shock wave moves through the propellant that compresses and heats the propellant. The shock wave is partially reflected off the case shoulder toward a central interior portion of the case. As pressure behind the shock wave begins to move the projectile, the propellant plug approximately the diameter of the projectile is sheared away from the body of the charge. Ignition along the resulting shear surface is rapid because only an infinitesimal gas path out of the shear layer exists causing a rapid pressure and temperature buildup. The portion of the propellant plug which is exposed to the case neck can only burn from the aft end forward due to the quenching effect of the case neck and later the barrel bore.

Burning rates for propellants used in the bottleneck case must be slower because of the additional burning surface of the propellant plug and exposed propellant shear surface. In the region where unignited powder exists, exposure of the case wall to combustion gas occurs when the propellant is consumed. As this material burns forward from the base and through from the interior surface, more of the case is exposed to direct heating, therefore, heat loss increases. Thus, heat and acceleration losses are lower with the bottleneck case but are still excessive. Ballistic calculations utilize empirically derived coefficients drawn from the vivacity curve, such as progressivity, regressivity, and progressivity-regressivity rollover coefficients to define the pressure in a cartridge as a function of time or bullet movement. However, the burning surfaces of the propellant are not quantitatively defined.

In firearm manufacturing, it is desirable to increase the propulsion of the projectile for improved velocity range and accuracy. Projectile velocity and propulsive efficiency have been increased through the use of high energy smokeless powders. Other improvements have resulted from increased case capacity, improved primer design, and better metallurgy for cases and firearms with higher operating pressures. The shape of the case has also been altered, as discussed above, to create the bottlenecked case that increases case capacity to reduce heat and acceleration losses. Improvements thus far have relied upon empirically derived coefficients that do not accurately model pressure over time. Thus, such improvements fail to provide an optimal configuration.

In improving a cartridge several design parameters must be considered within the framework of the combustion process described above. One parameter is to minimize heat losses to the cartridge case, projectile base, and gun barrel. This may be done by protecting cartridge surfaces from combustion heat where possible. Heat losses may also be minimized by reducing the interior surface area of the case as much as possible for the required propellant volume. Another parameter is to maximize the pressure-time integral of propellant combustion within pressure limitations of the firearm design. A further parameter is to complete as much combustion as possible within the cartridge case to minimize heat loss and damage to the firearm barrel. Yet another parameter is to minimize mass and acceleration of uncombusted propellant to conserve combustion energy.

Thus, it would be an advancement in the art to improve the propulsive efficiency of a cartridge. It would be an advancement in the art to increase bullet velocity for a given amount of propulsive medium, such as gun powder. It would also be an advancement in the art to be able to calculate pressure as a function of time directly from propellant burn rates and surface areas without resorting to empirically derived coefficients. Such a cartridge and case-less gun chamber design is disclosed herein.

BRIEF SUMMARY OF THE INVENTION

This disclosure describes the mode of propellant combustion and a design process for the design of metal cased cartridges and for case-less gun chambers for all gun sizes. In one embodiment the firearm cartridge has a case configured with a relatively straight-walled body portion that is connected to a base or aft end. A shoulder is connected to the body portion at a body-to-shoulder junction. The body portion defines a body cavity having an interior body diameter at the body-to-shoulder junction. The body cavity is sized and configured to contain a quantity of a propellant. The shoulder may take a variety of configurations. For instance, the shoulder may be a frusto-conical shoulder or it may be a curved shoulder. Examples of some curved shoulder configurations are disclosed in U.S. Pat. No. 6,523,475. A neck connects to the shoulder at a neck-to-shoulder junction. The neck has an interior neck diameter. A bullet is at least partially nested within the neck. The ratio of the interior body diameter to the interior neck diameter is preferably in the range from about 1.8:1 to 2.3:1. The interior neck diameter is sized to retain a bullet at least partially nested therein. The case is sized and configured to contain a sufficient quantity of propellant such that igniting the propellant by means of a primer causes formation of a propellant plug having a diameter that is approximately the diameter of the bullet. The shoulder is connected to the neck at an angle of approximately 40 degrees or more which causes the propellant plug to shear free from unburned propellant that is disposed adjacent the relatively straight-walled body portion.

A case-less gun chamber may be configured similarly to the cartridge. As such, the chamber would have a diameter at the body-to-shoulder junction that would be approximately two or more times the neck diameter at the neck-to-shoulder junction. More specifically, the ratio of the body diameter to the neck diameter would be about 1.8:1 to 2.3:1. The chamber would include a shoulder that would be connected to the neck through a neck-to-shoulder junction at an angle of approximately 40 degrees or more.

The foregoing ratio of the interior body diameter to interior neck diameter optimizes combustion efficiency. The increased diameter creates a greater primary ignition zone and reduces heat loss by having a thicker layer of propellant on the interior case surface until burnout. Acceleration losses are reduced as the length of the propellant plug is reduced. The case dimensions further provide for simultaneous burn in the propellant plug and propellant wall to reduce inefficiency and waste. This results in more burning in the neck and case interior rather than within the barrel.

The neck, case wall, and the bullet base may further be coated with a reflective, insulation coating to reduce quenching of the propellant adjacent the neck and bullet base. The coating accelerates burning fronts, reduces heating and acceleration losses, and further adds to the propulsive forces behind the bullet base. Examples of such reflective, insulating coatings are found in U.S. Ser. No. 10/283,635, filed Oct. 30, 2002 which is incorporated by reference.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in the figures is not intended to limit the scope of the invention as claimed, but is merely representative of presently preferred embodiments of the invention.

The present invention is directed to improved cartridges and case-less gun chambers with reduced heat and acceleration losses. With all cartridges experiencing combustion, that portion of a propellant not initially ignited is quickly compressed into a heterogeneous mass with properties similar to a very high viscosity fluid. The trapped air contained in the propellant has more compressibility than the propellant granules. The trapped air heats the propellant it is in contact with by adiabatic compression, thereby increasing the subsequent combustion rate. As the ignited propellant granules begin to burn, the pressure rises further. The increased pressure compresses the unignited propellant until the projectile begins to move from a cartridge case into the barrel. A shock wave caused by the ignition of the primer is transmitted through the propellant and trapped air to the case wall. A part of the shock wave is then reflected back into the compressed propellant and throughout the cartridge and chamber.

As the projectile begins to move, a plug of propellant of approximately the same diameter as the projectile is sheared away from the compressed mass of the powder or the case wall. The plug may be subsequently ignited along the sheared interface depending on whether the sheared surface is in the propellant or along the case wall. The plug follows or pushes the projectile until it is either consumed by the combustion process or combustion slows or ceases due to the pressure drop caused by projectile acceleration or by the projectile exiting the muzzle. Combustion of the remainder of the propellant begins within the cartridge case or as the granules become entrained into flowing combustion gases as the gases flow into the case neck and barrel bore. By better understanding the combustion process, improvements may be made to conventional cartridges and case-less gun chambers. These improvements are disclosed herein.

Figure 1C:
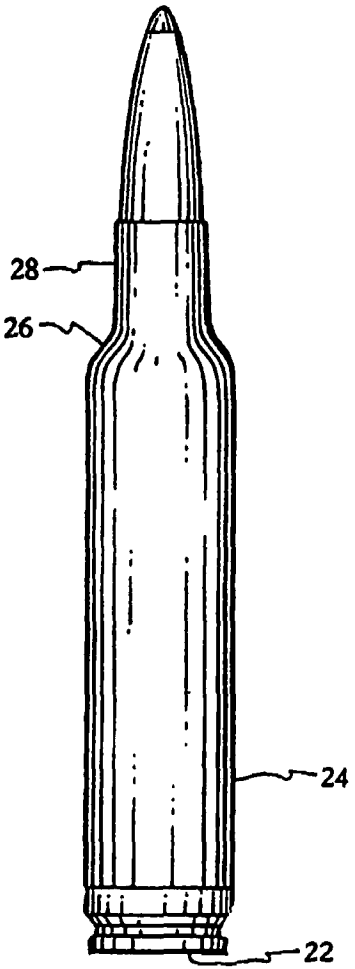
Fig.1C Prior Art
FIGS. 1A, 1B, and 1C are side views of firearm cartridges.
Figure 1B:
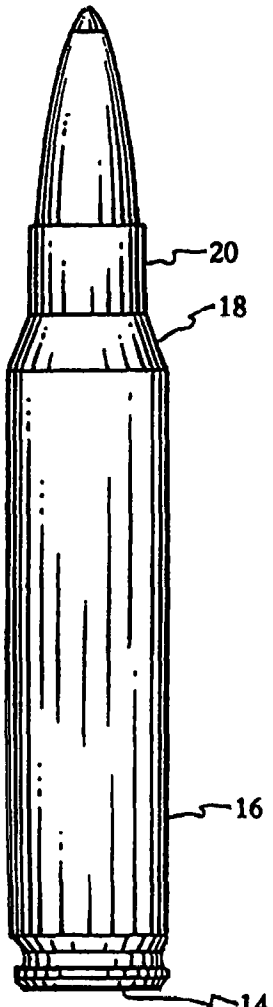
Fig.1B Prior Art
Figure 1A:
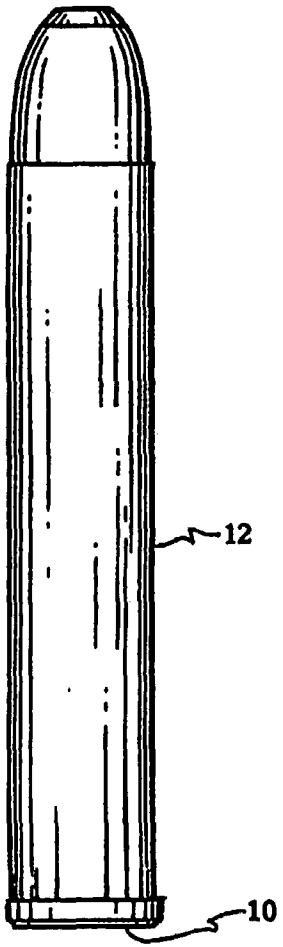
Fig.1A Prior Art

Referring to FIGS. 1A, 1B, and 1C, side views of conventional firearm cartridges are shown. FIG. 1A illustrates a straight-walled cartridge 10 that has a cylindrical case 12 with little or no taper. FIG. 1B illustrates a bottlenecked cartridge 14 having a case 16 configured with a frusto-conical shoulder 18 that tapers to a neck 20. FIG. 1C illustrates an alternative bottleneck cartridge 22 having a case 24 configured with a radius shoulder 26 that tapers with a reverse radius to a neck 28. The design differences between the straight-walled cartridge 10 and the bottleneck cartridge 14, 22 result in different performances and functions.

Figure 2A:
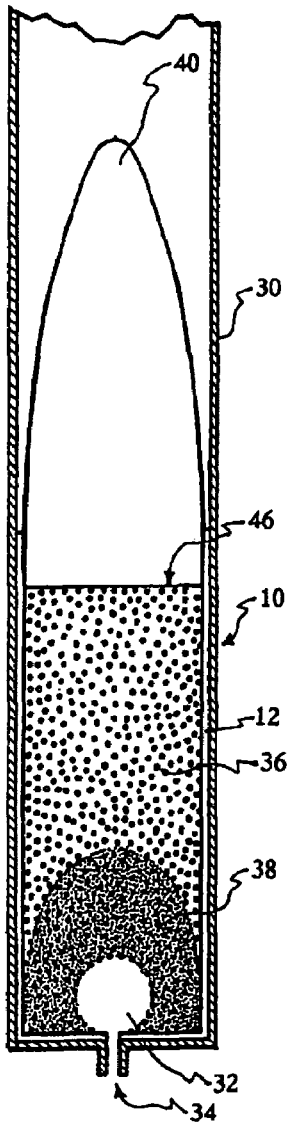
FIGS. 2A, 2B, and 2C are cross-sectional views of a straight-walled cartridge undergoing combustion.
Figure 2B:
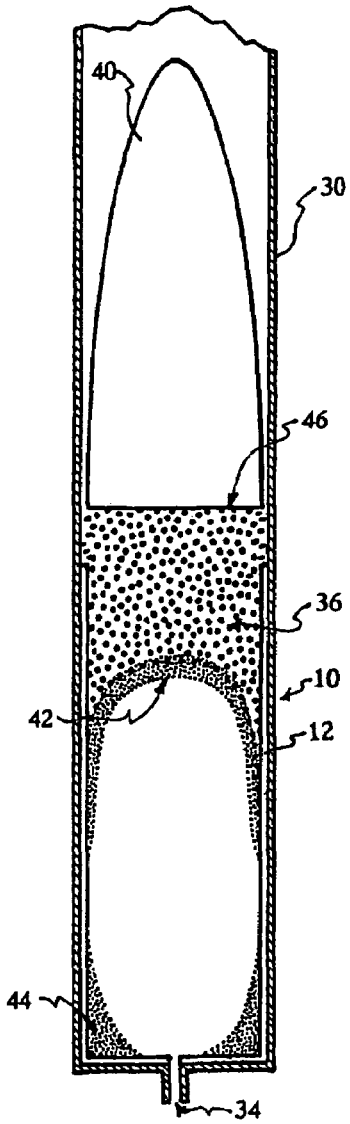
Figure 2C:
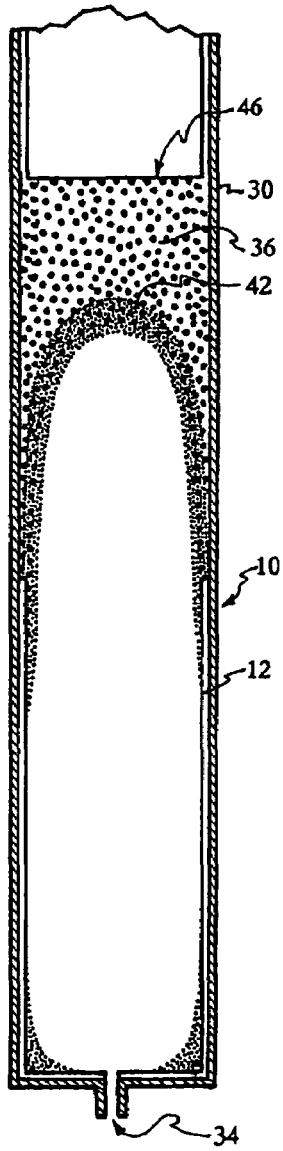

Referring to FIGS. 2A, 2B, 2C there is shown side cross-sectional views of the straight-walled cartridge 10 undergoing the combustion process in a gun chamber 30. In FIG. 2A, a representation of the straight-walled cartridge 10 is shown shortly after primer ignition. The ignition releases a nascent gas pocket 32 through a flash path 34 and into the propellant 36 to create a zone of primary ignition 38. The propellant 36 may be normal, black, or smokeless powder with entrained air. The unignited granules of the propellant 36 are compressed into a heterogeneous mass which has the properties of a viscous fluid.

In FIG. 2B, the straight-walled cartridge 10 is shown as the bullet 40 begins to move forward towards the muzzle of the barrel. A zone of nascent ignition 42 proceeds through the propellant 36 to heat the propellant but does not completely combust all of the propellant 36. Ignition is complete, but the propellant 36 continues to burn. Adjacent the flash path 34, near complete combustion 44 of the propellant 36 occurs. A shock wave from the primer compresses the propellant 36 and pushes against the bullet base 46 to dislodge the bullet 40. The propellant 36 is further compressed into a heterogeneous mass of granules and trapped gases. During combustion, the propellant 36 shears from the case wall 12. However, because of the higher thermal conductivity of the case wall 12 there is heat loss and propellant along the case wall is quenched and does not ignite.

In FIG. 2C, the straight-walled cartridge is shown as the bullet 40 proceeds further towards the muzzle. Pressure near the bullet 40 drops as the bullet 40 accelerates thereby reducing the propellant 36 burn rate. Propellant 36 that is not consumed before the bullet 40 leaves the muzzle is expelled and does not contributed to bullet acceleration.

Figure 3A:
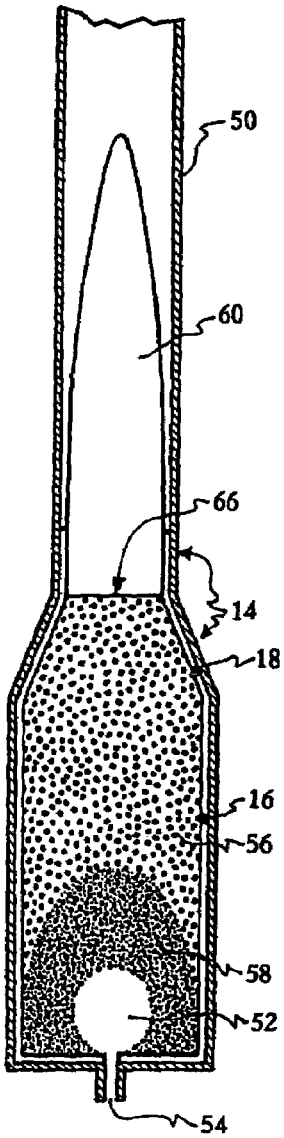
FIGS. 3A, 3B, and 3C are cross-sectional views of a bottle-necked cartridge undergoing combustion.
Figure 3B:
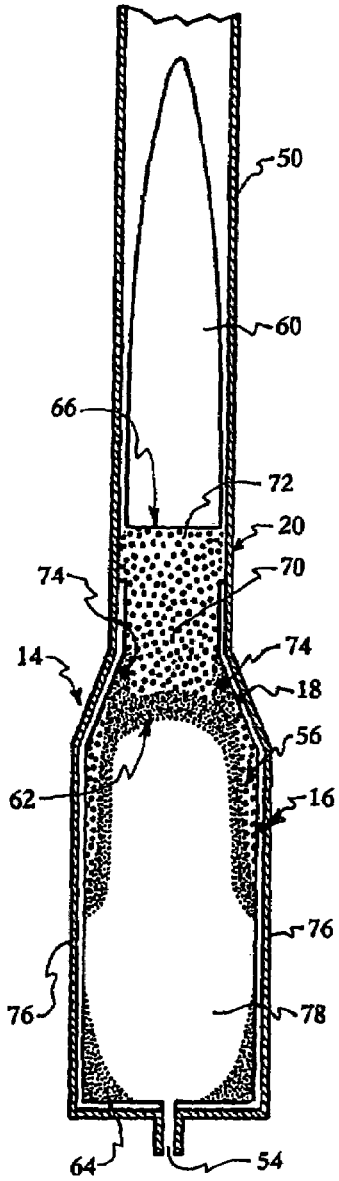
Figure 3C:
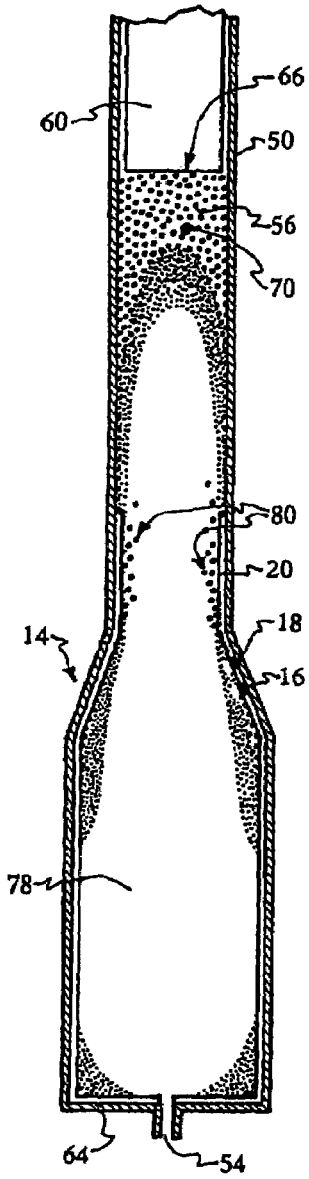

Referring to FIGS. 3A, 3B, 3C there is shown side cross-sectional views of the bottlenecked cartridge 14 undergoing the combustion process in a gun chamber 50. In FIG. 3A, the bottlenecked cartridge 10 is shown shortly after primer ignition. The ignition releases a nascent gas pocket 52 through a flash path 54 and into the propellant 56 to create a zone of primary ignition 58. The unignited granules of the propellant 56 are compressed into a heterogeneous solid.

In FIG. 3B, the bottlenecked cartridge 14 is shown as the bullet 60 begins to move forward towards the muzzle of the barrel. A zone of nascent ignition 62 proceeds through the propellant 56 but does not completely combust all of the propellant 56. Adjacent the flash path 54, near complete combustion 64 of the propellant 56 occurs. A shock wave from the primer compresses and heats the propellant 56 and pushes the bullet base 66. The shockwave partially reflects off the case shoulder 18 toward an internal central portion of cartridge 14 to dislodge the bullet 60. The propellant and entrained air 56 may be compressed 10 to 25% before the bullet begins to move.

A propellant plug 70 that is the approximately the diameter of the bullet 60 shears away from the remaining propellant 56. The portion of the propellant plug 70 that is exposed to the case neck 20 during bullet 60 movement only burns from an aft end forward due to the quenching effect of the case neck 20 and the barrel bore. A base zone 72 of the propellant plug 70 is compressed and volume reduced by the shockwave of the primer ignition and subsequent pressure rise from propellant combustion. Pressures experienced by the zone 72 can be 3000 psi or more which reduces propellant volume by 10 to 20 percent.

A shear zone 74 exists where the propellant plug 70 breaks from the remaining propellant 56. Ignition in the shear zone 74 is quenched by the adjacent cooler and conductive case wall 16. In bottlenecked cartridges, nascent ignition along the shear zone 74 increases combustion of the surface area. A high heat loss zone 76 develops where completely combusted propellant 56 exposes the conductive case wall 16. After combustion, a void zone 78 develops within the cartridge 14 as a result of compression and displacement of unignited powder.

In FIG. 3C, the bottlenecked cartridge is shown as the bullet 60 proceeds further towards the muzzle. Granules 80 are stripped away from the case wall 16 by convection as trapped mass flows into the neck 20.

Figure 4A:
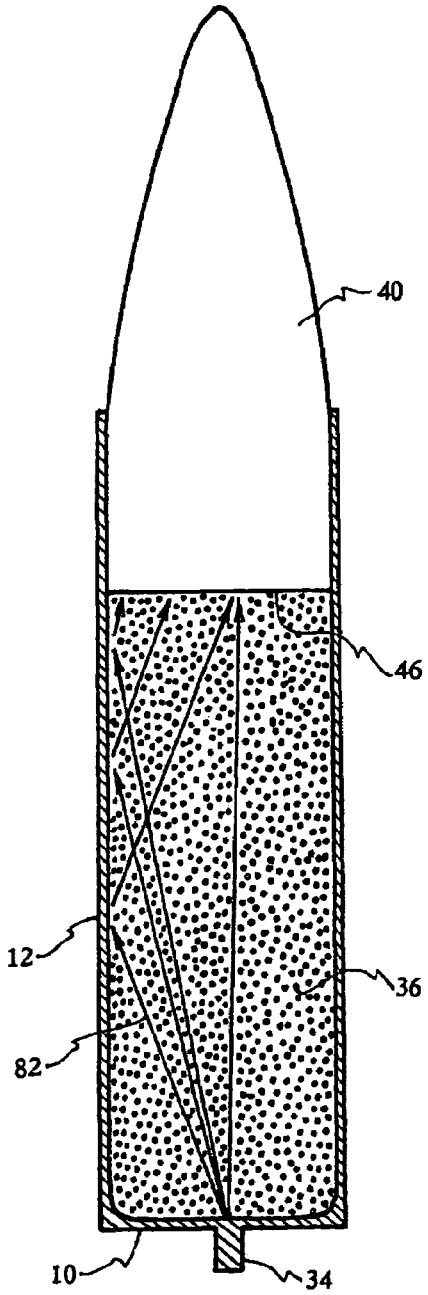
FIGS. 4A and 4B are cross-sectional views of cartridges experiencing shockwaves from primer ignition.
Figure 4B:
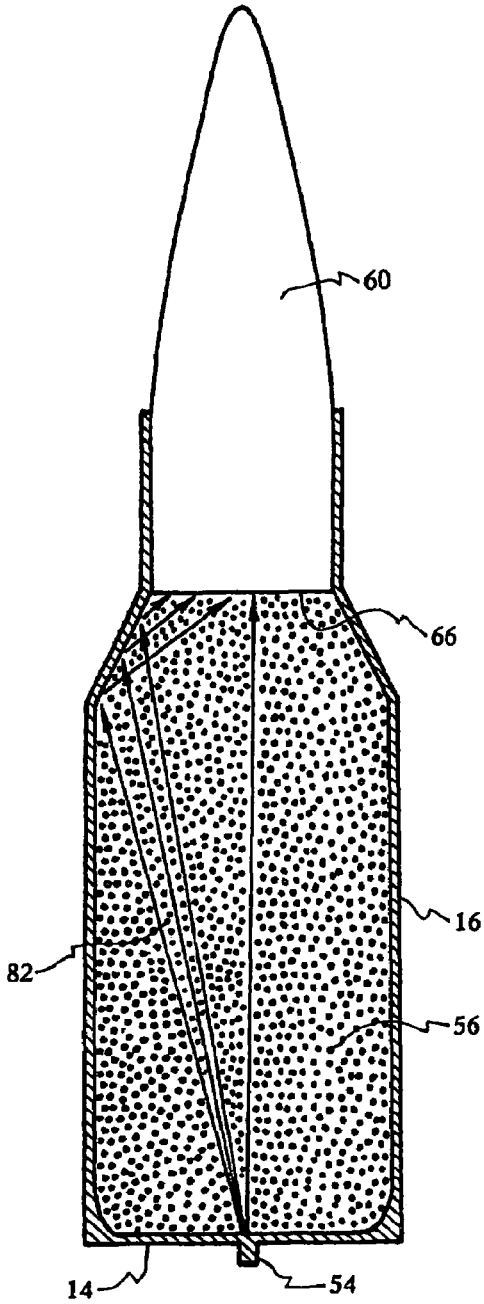

Referring to FIGS. 4A and 4B, cross-sectional views of a straight-walled cartridge 10 and a bottlenecked cartridge 14 are shown. Shockwaves 82 generated from the primer ignition transmit through the propellant 36, 56 and push on the bullet base 46, 66. Most shockwaves 82 reflect off the case 12, 16 before impacting the bullet base 46, 66. Almost all energy generated by the shockwaves 82 reflects or directly impacts the bullet base 46, 66. This is detrimental as the bullet 40, 60 is heated and dislodged prematurely before ignition of the propellant 36, 56 is well underway.

Figure 5A:
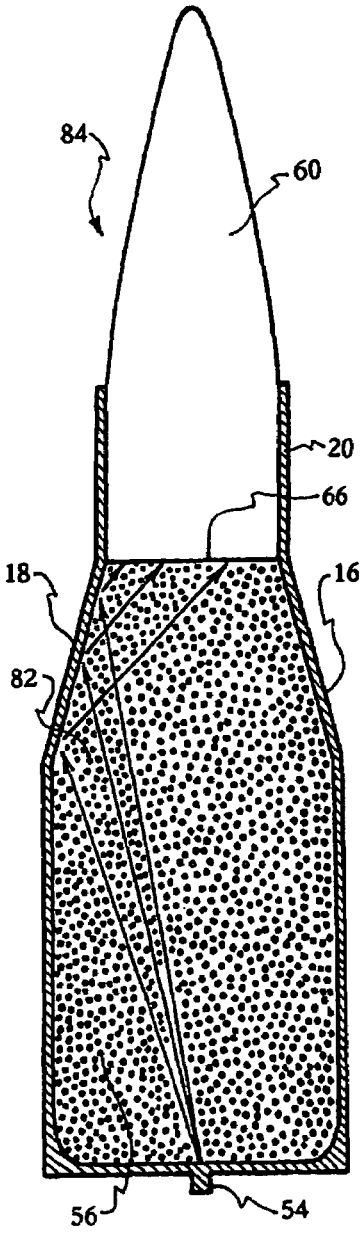
FIGS. 5A, 5B, and 5C are cross-sectional views of cartridges experiencing shockwaves from primer ignition.
Figure 5B:
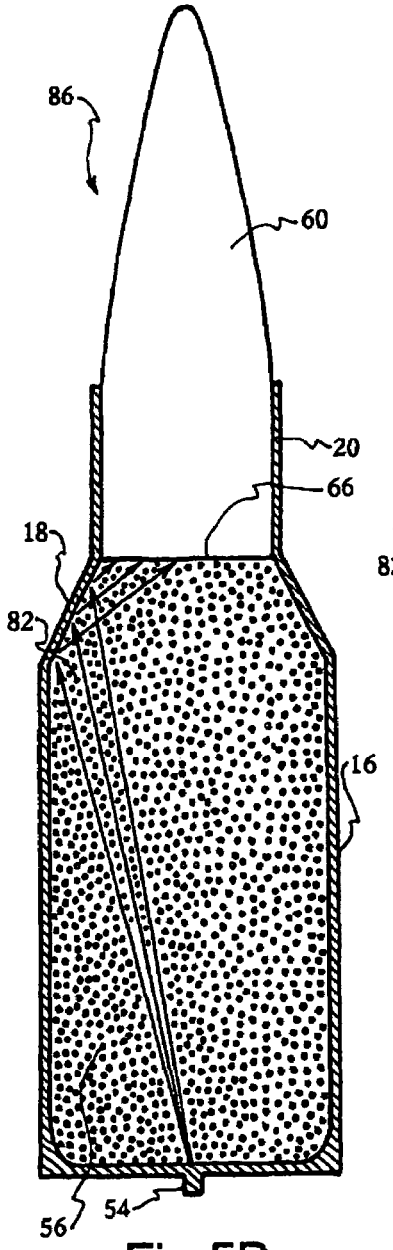
Figure 5C:
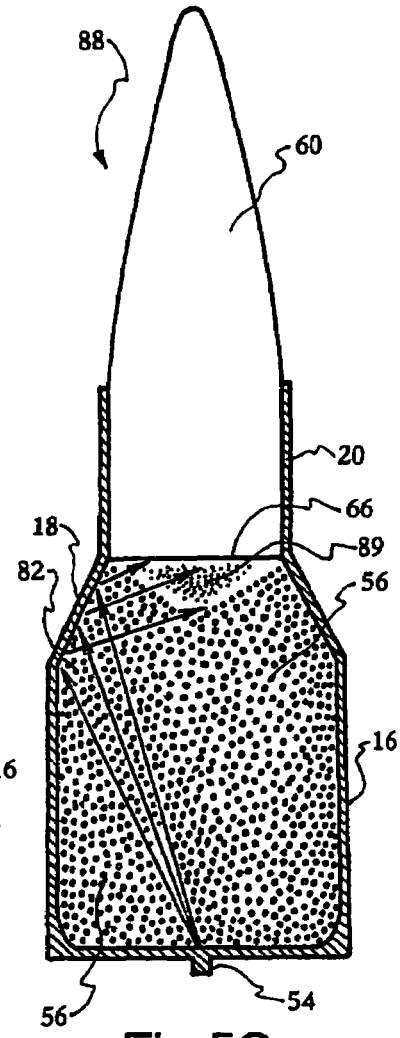

Referring to FIGS. 5A, 5B, and 5C different embodiments of bottleneck cartridges 14 are shown. The shoulder 18 may be configured to focus shockwaves 82 at different points. In FIGS. 5A and 5B, the bottleneck cartridges 84, 86 are configured with 15 and 30 degree frusto-conical shoulders 18 respectively. The bottleneck cartridges 84, 86 are termed in the art as a "long case" due to a common predesignated case length. Most of the shockwave 82 energy reflects onto the bullet base 66 and prematurely dislodge the bullet 60.

In FIG. 5C, the bottleneck cartridge 88 is configured with a 30 degree frusto-conical shoulder 18 and is termed in the art as a "short case." A short case may have a case 16 that is 30 to 50 percent shorter than a long case. With the bottleneck cartridge 88, more shockwave 82 energy reflects into the propellant 56 adjacent the bullet base 66. This region is referred to herein as the focus zone 89, as this is where shockwaves 82 should be focused for improved performance. This is advantageous as heating in this zone 89 of the propellant 56 accelerates subsequent granule ignition and burning in this zone 89. As this region later becomes the propellant plug 70, burning and ignition in this zone 89 is greatly increased. Furthermore, premature dislodging of the bullet 60 is reduced.

Figure 6A:
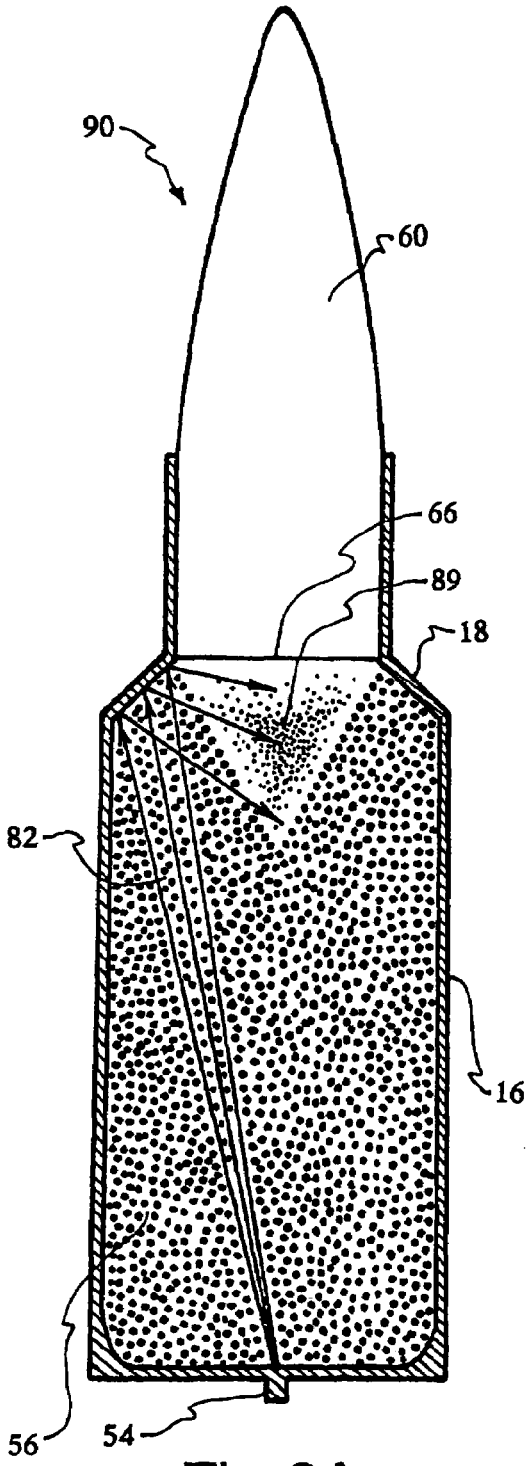
FIGS. 6A and 6B are cross-sectional views of cartridges experiencing shockwaves from primer ignition.
Figure 6B:
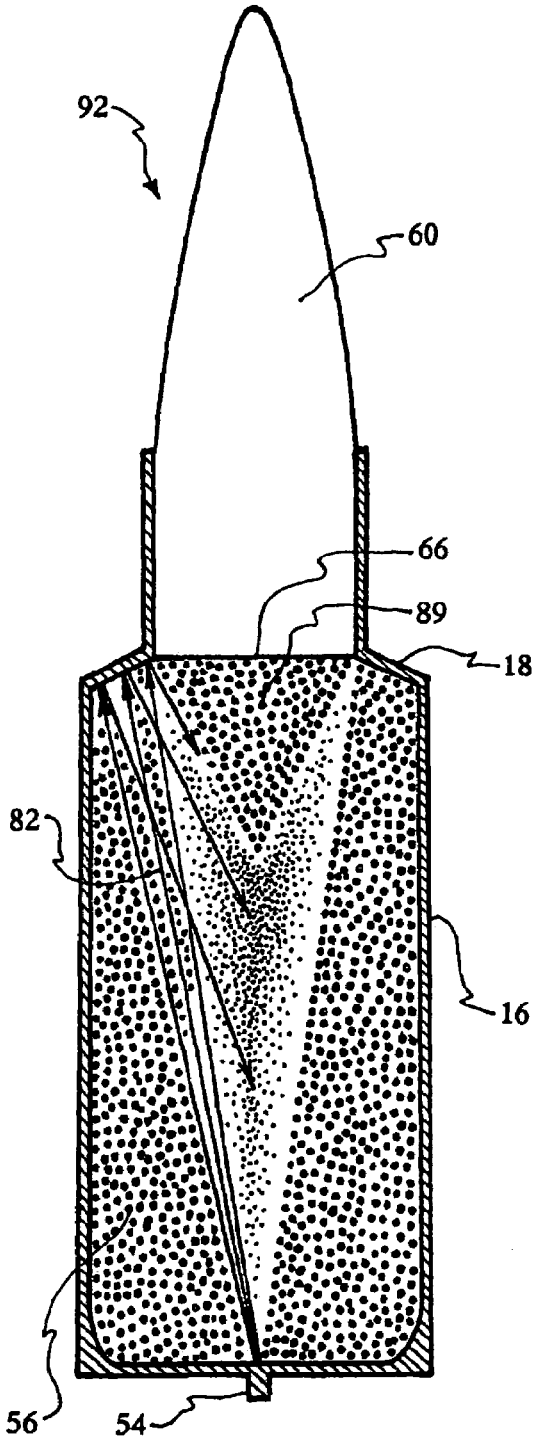

Referring to FIGS. 6A and 6B alternative embodiments of bottleneck cartridges 14 are shown. In FIG. 6A, the bottleneck cartridge 90 is configured with a 45 degree frusto-conical shoulder 18 and is a long case. A frusto-conical shoulder 18 with an angle greater than 40 degrees may dissipate the shockwaves 82 rather than direct the shockwaves 82 to the focus zone 89. Dissipation is also dependent on the case length. Thus, the bottleneck cartridge 90 focuses some of the shockwaves 89 into the focus zone 89 and dissipates other shockwaves 82.

In FIG. 6B, the bottleneck cartridge 92 is configured with a 60 degree shoulder 18 and is a long case. With this shoulder angle, little shockwave 82 energy reflects into the focus zone 89. Instead, the shockwaves 82 are largely dissipated throughout the propellant 56. Resultant granule heating is of little benefit as heating occurs in granules that do not require additional heating. These granules are almost entirely consumed during initial combustion and through burn.

Figure 7A:
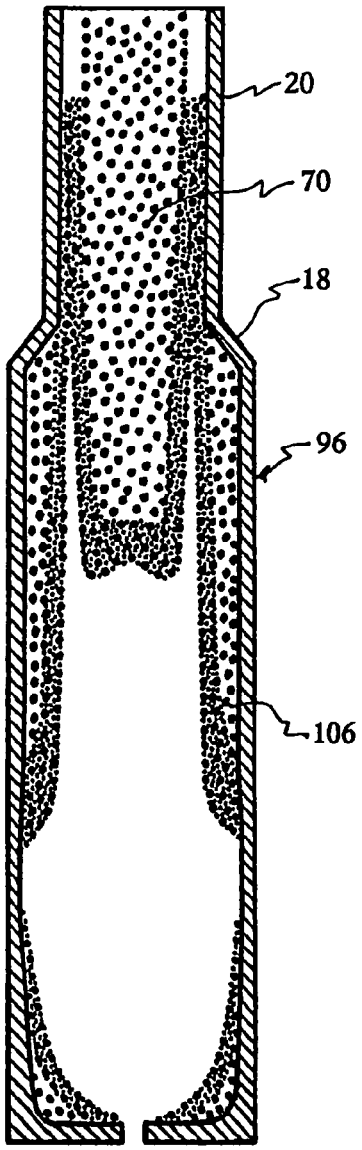
FIGS. 7A and 7B are cross-sectional views of cases undergoing combustion.
Figure 7B:
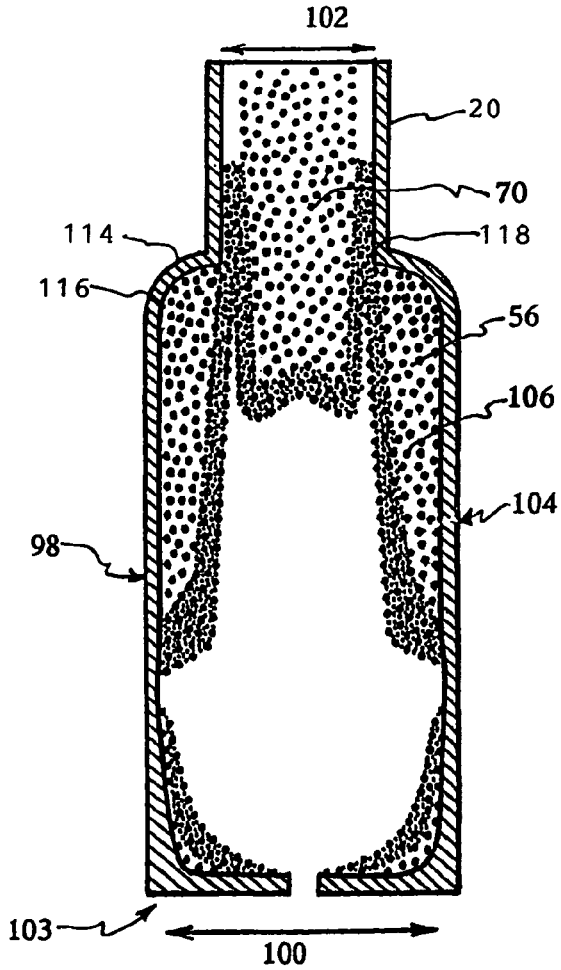

Referring to FIGS. 7A and 7B, cross-sectional side views of different embodiments of cases 16 for bottleneck cartridges 14 are shown. In FIG. 7A, a conventional long case 96 is shown which has a relatively small diameter compared to the case length. In FIG. 7B, one embodiment of a case 98 of the present invention is shown. The case 98 has an internal body diameter 100 that is approximately 1.8 to 2.3 times the bullet diameter or the internal neck diameter 102. More preferably, the internal body diameter is approximately 2 to 2.2 times the internal neck diameter. The internal body diameter is preferably measured at the junction 116 of the shoulder 114 to the straight walled portion 104. The internal neck diameter 102 is preferably measured at the junction 118 of the shoulder 114 to the neck 20. The case 98 is also configured to be a short case in that the length of a straight walled portion 104 of the case 98 is substantially shorter than a conventional long case. Configured as such, the case 98 may have approximately the same internal volume as the long case shown 96.

For purposes of reference, a case 98 having an internal body diameter 100 of approximately two or more times greater than the internal neck diameter 102 is referred to herein as a "fat" case. A cartridge having a fat case is referred to herein as a "fat" cartridge. The surface area-to-volume ratio of the fat cartridge is less than a bottleneck cartridge. The unique ratio of the fat cartridge reduces the area heated by combustion and reduces subsequent heat loss through the cartridge case wall.

Both cases 96, 98 are shown in a state of combustion. The fat case 98 has less propellant 56 in its propellant plug 70 than the case 96 has in its propellant plug 70. The plug 70 of the fat case 98 is shorter which reduces the mass of the plug 70 that is accelerated with the bullet 60. This reduces acceleration and heat loss that occurs with a plug 70 of greater mass.

A further advantage of the fat case 98 is that the case 98 maximizes the amount of pressure time. The pressure tends to rise to a peak more rapidly due to the larger surface area at an aft end 103 of the case 98. The pressure remains high until almost all the propellant 56 is consumed. A sharp drop off in pressure then occurs.

Another advantage of the fat case 98 is that as combustion proceeds, the total area of the interior fat case 98 insulated by unburned powder is substantially greater. Thus, much of the internal case surface is covered with unburned propellant until it is consumed by burning. During subsequent burning that occurs after ignition, there is a thicker wall 106 of propellant 56 adjacent the case wall. It requires more time to burn through the propellant wall 106 of the fat case 98 than it does to burn through the propellant wall 106 of the case 96. Total exposure of the case wall to heat is a function of exposed area multiplied by time. Because more time is required to burn through the propellant wall 106, exposure of the interior case wall to heat and propellant gases is reduced. Heat losses to the interior case wall are reduced in the case 98.

It is further advantageous to have the plug 70 and the propellant wall 106 burn and expire approximately simultaneously so that both contribute to the propulsion. The dimensions of the fat case 98 provide this by having the propellant wall 106 being approximately half as thick as the plug 70.

Figure 8A:
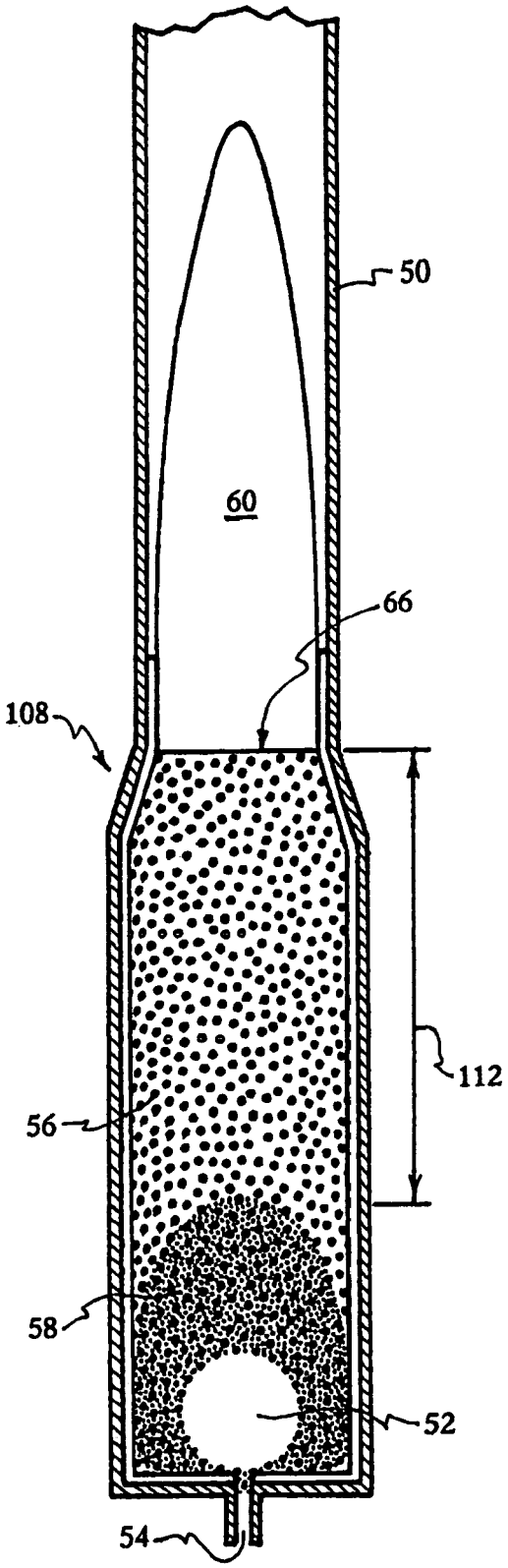
FIGS. 8A and 8B are cross-sectional views of cartridges undergoing primer ignition.
Figure 8B:
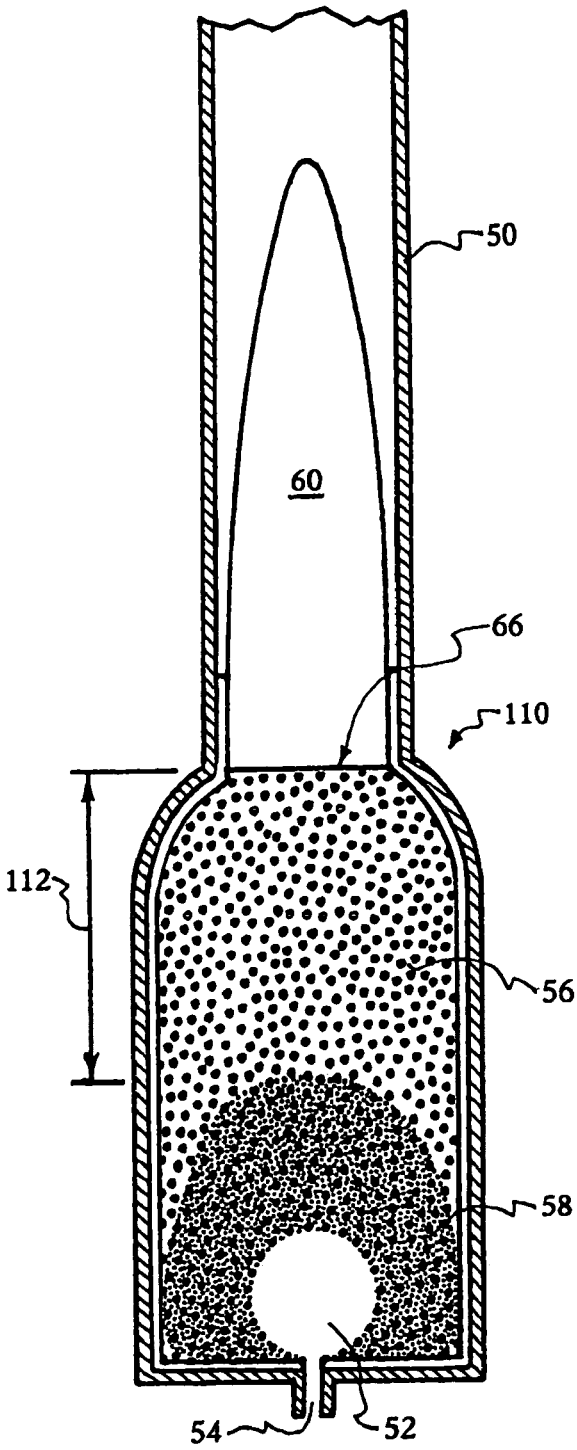

Referring to FIGS. 8A and 8B, cross-sectional side views of a conventional cartridge 108 and a fat cartridge 110 within the scope of the present invention is shown. The cartridges 108, 110 are shown in a state of primary ignition. As shown, the fat case 110 has dimensions that create a greater primary ignition zone 58 than the case 108. Thus, there is a greater initial combustion with greater heat and pressure with the fat case 110. Less propellant remains unignited which results in less burn time and less time for heat loss. Furthermore the length 112 of the column of unignited propellant 56 to be accelerated is less with the fat case 110. This results in reduced acceleration losses.

Figure 9:
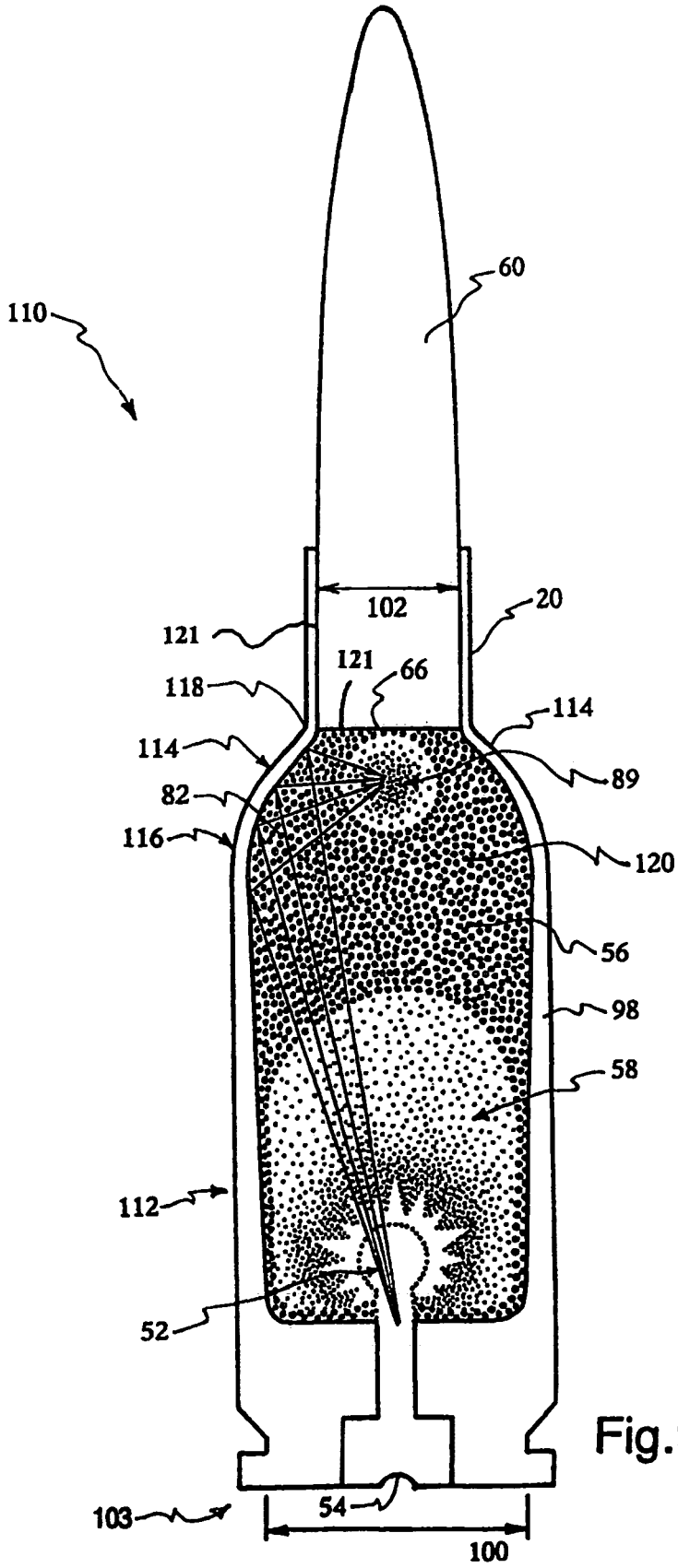
FIG. 9 is a cross-sectional view of one embodiment of a cartridge of the present invention during primer ignition.

Referring to FIG. 9 a cross-sectional view of one embodiment of a fat cartridge 110 within the scope of the present invention is shown. In the embodiment shown, the fat cartridge 110 is configured as a bottleneck cartridge having a curved shoulder 114. Although the curved shoulder 114 provides performance advantages discussed below, the fat cartridge 110 may be configured with a frusto-conical shoulder configuration with a shoulder angle of approximately 40 degrees or more to facilitate propellant plug shear line formation.

In the embodiment of FIG. 9, the shoulder 114 is radial and centers a longitudinal axis (not shown) of the cartridge 110. The radial shape of the shoulder 114 may be defined by an ellipsoid, sphere, or paraboloid configuration. As such, a phantom ellipsoid, sphere, or paraboloid may be overlaid the shoulder 114 and centered around the longitudinal axis. This differs from conventional radial shoulders which are configured independent of the longitudinal axis.

The shoulder 114 focuses the reflected shockwaves 82 into the focus zone 89 which is adjacent the bullet base 66. The optimal configuration for a shoulder 114 is a factor of focus points of an ellipse between the flash hole 54 and near but not at the bullet base 66. When the focus points converge, the shoulder configuration becomes spherical. When the fat case 98 is elongated, a single focus point is located near the bullet base 66 and the shoulder configuration becomes parabolic. Further discussion on the defining shoulder configuration follows below.

Focusing of the shockwaves 82 to the focus zone 89 results in an increase in the ignition rate and burn of the propellant 56 in the zone 89 by adiabatic heating of trapped air and reduces losses associated with acceleration of unignited propellant 56. Focus of the shockwaves 82 away from the bullet base 66 further reduces the tendency to dislodge the bullet 60 from the neck 20 until ignition of the propellant is further advanced. This further reduces heat loss to the bullet base 66 and neck 20 due to compression of air trapped within the propellant 56. Furthermore, the amount of unburned propellant in the plug 70 is reduced and less propellant 56 accelerates down the bore with the bullet. Focus of the shockwaves 82 further results in less shock energy being transmitted axially to the gun barrel which results in less barrel vibration and greater intrinsic accuracy of the gun.

The base portion 112 of the cartridge 110 is defined as the straight-walled portion of the fat case 98 that extends from the aft end 103 to the junction 116 where the shoulder 114 begins. The length of the base portion 112 may vary based on required propellant capacity. In one embodiment, the base portion 112 has a length that approximates a short case. The bullet 60 is preferably seated such that the bullet base 66 is at a neck/shoulder junction 118.

Although the shoulder 114 may be configured as being radial, in that it is elliptical, spherical, or parabolic, the neck/shoulder junction 118 is non-radial. This differs from the cartridge 22 of FIG. 1C. A radial neck/shoulder junction 118 is detrimental because it facilitates movement of the unignited propellant 56 into the barrel. This movement increases case interior exposure to the flame front and acceleration losses due to excessive propellant 56 movement. This causes destructive heating due to combustion in the barrel. Thus, the present invention does not provide a reverse radial of the shoulder curvature.

Figure 17A:
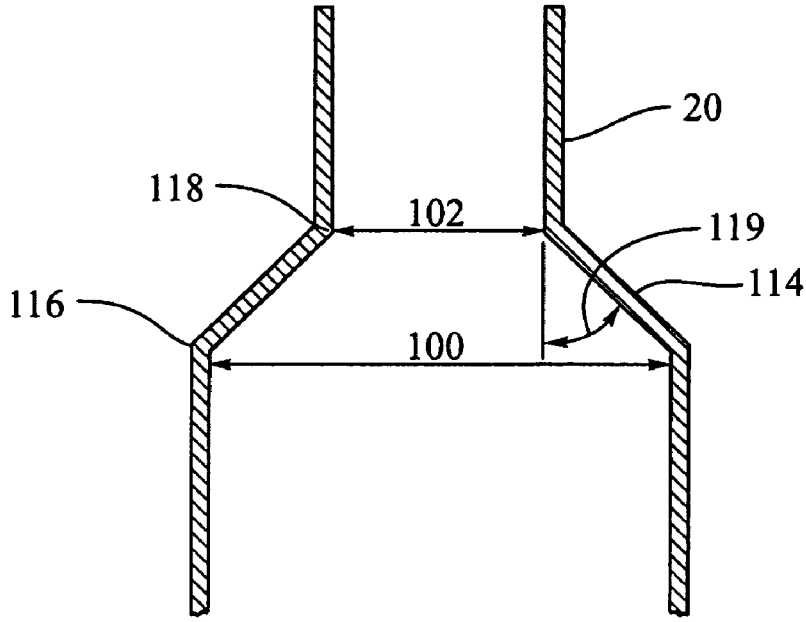
FIGS. 17A and 17B are cross-sectional views of cartridge cases showing the angle of the neck-shoulder junction.
Figure 17B:
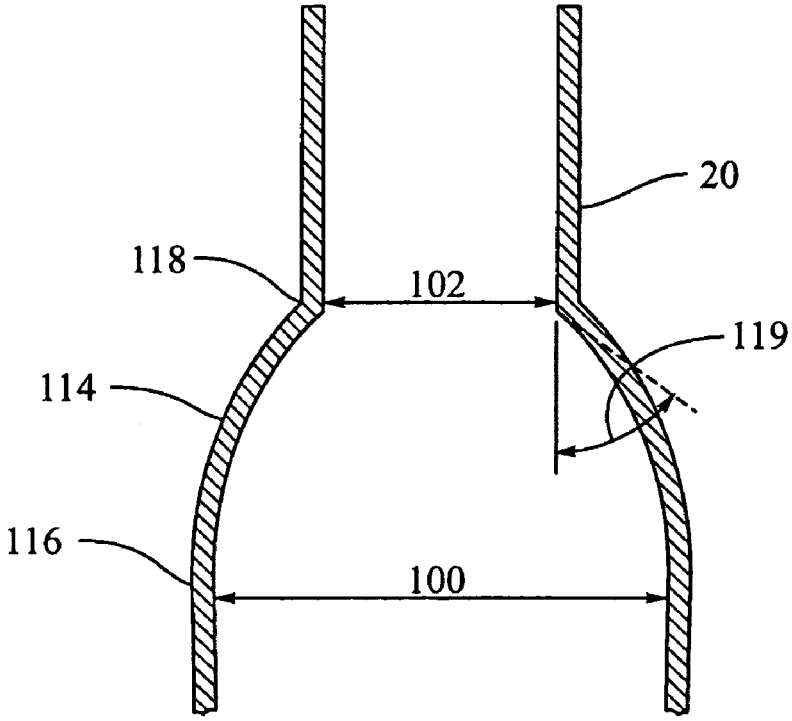

With the neck/shoulder junction 118 being non-radial, a shoulder angle may be measured at the neck/shoulder junction. The shoulder angle 119 is preferably approximately 40 degrees or more. The shoulder angle 119 is measured relative to the longitudinal axis of the cartridge, or for convenience, relative to the direction of the neck, as shown in FIGS. 17A and 17B.

During combustion, the primer ignition creates a developing nascent gas pocket 52 within the propellant 56 that pulverizes and compresses the granules. The primary ignition zone 58 results in direct granule ignition. In between the focus zone 89 and the primary ignition zone 58 is a zone referred to herein as a compression zone 120. The compression zone 120 experiences substantial granule compression from the primer ignition and the nascent combustion.

In one embodiment, the inside surface of the neck 20 and the bullet base 66 are coated with a reflective, thermally insulating coating 121 to reduce heat loss and subsequent propellant ignition quenching. The coating 121 has a thermal breakdown temperature higher than the ignition temperature of the propellant 56 to advance the flame front by reflecting heat and increase burning at the interior case wall. This allows more complete ignition of the propellant 56 in the adjacent areas by reducing heat loss and subsequent propellant ignition quenching at the interior surface of the neck 20 and the bullet base 66. With the reflective, insulated coating, the burning front advances further up the neck 20 from a shear zone 74.

An uninsulated interior case surface can quench combustion due to the high thermal conductivity and heat capacity of the case. The quenching may continue until the interior case surface is heated above the ignition temperature of the propellant. This results in significant heat loss and retards the movement of the burning front along the interior case wall and along the shear zone 74.

Figure 10:
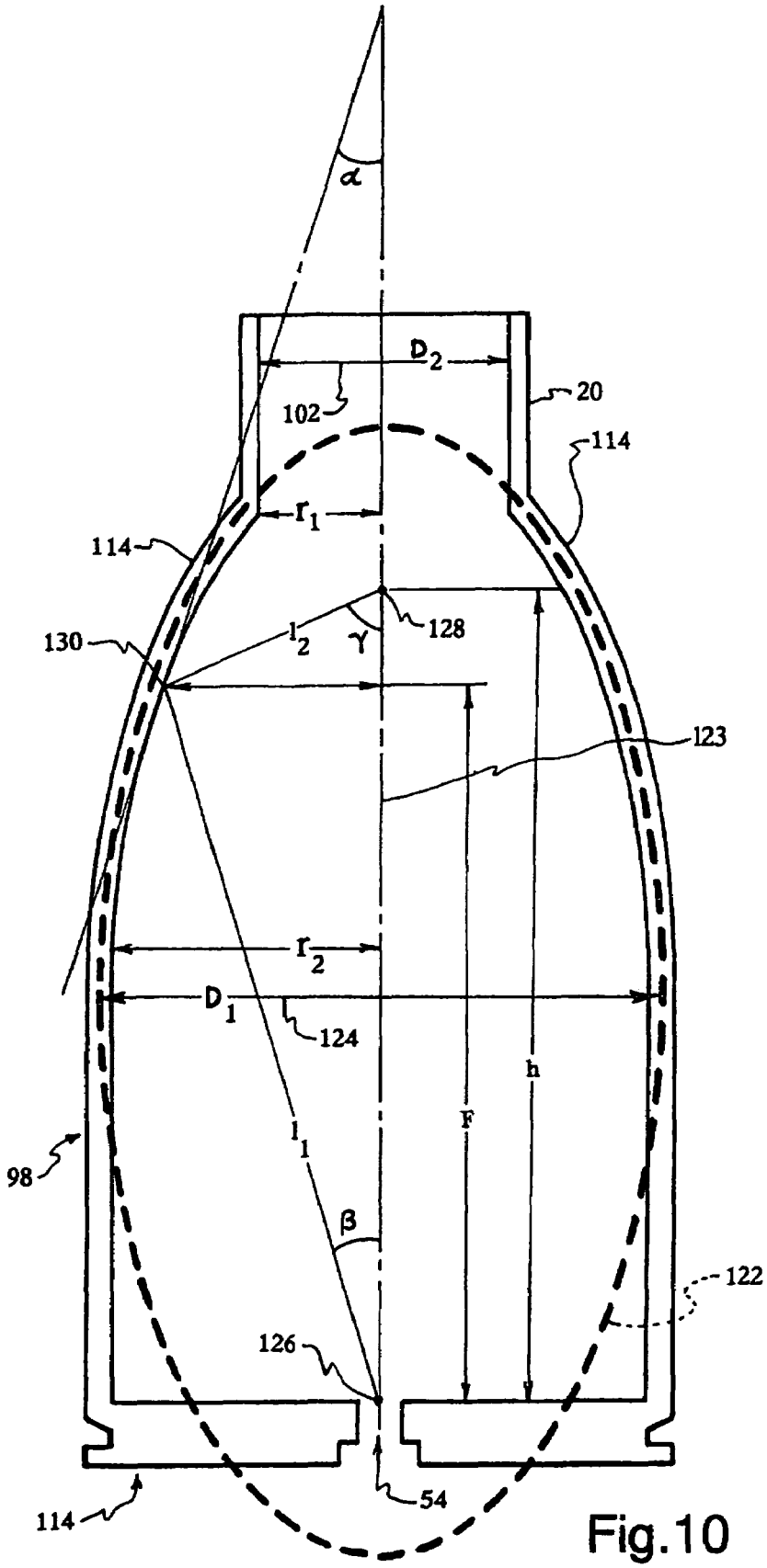
FIG. 10 is a cross-sectional view of one embodiment of a cartridge of the present invention.

Referring to FIG. 10, a cross-sectional view of the case 98 of FIG. 9 is shown to illustrate geometrical dimensions. In the embodiment shown, the shoulder 114 of FIG. 10 is ellipsoidal in that is defined by an ellipsoid 122. The ellipsoid 122 and the shoulder 114 are centered along the longitudinal axis 123. A cross-section of the ellipsoid 122 (shown in phantom) is illustrated in FIG. 10. The defining ellipsoid 122 has a minor diameter 124 that approximates the internal case diameter 100 and is approximately two or more times the bullet diameter or the internal neck diameter 102. The ellipsoid 122 has a focus 126 adjacent the face of the flash hole 54. The second focus 128 of the ellipsoid 124 is adjacent but not in contact with the bullet base 66. The second focus 128 is approximately the location of the desired focus zone 89. Shockwaves are directed to the second focus 128 and heat loss to the case 98 and to the bullet are reduced.

As per the definition of an ellipse, the sum of the distances from the foci 126, 128 to a reference point 130 on the ellipse is a given constant. Thus, $l_1+l_2$=constant (C). Properties for an ellipse further provide the following relationships for the illustrated angles:

$$\gamma-\alpha=+\alpha;$$

$$\gamma-=2\alpha; \text{ and}$$

$$\alpha=(\gamma-)/2.$$

The radius, $r_2$, of the minor axis is equal to twice the radius, $r_1$, of the internal surface of the neck 20. The variable S is defined as the distance from the major axis to the reference point 130. The variable F is defined as the distance between the focus point 126 and the intersection of S with the major axis. The variable h is defined as the distance between the two foci 126, 128.

For these given relationships and variables the following equations are derived:

$$C=((F)^2+(S)^2)^{1/2}+((h-F)^2+(S)^2)^{1/2};$$

$$\beta=\text{arcTan}(S/F);$$

$$\gamma=\text{arcTan}\ (S/(h-F)); \text{ and}$$

$$\alpha=2[\text{arcTan}(S/F)-\text{arcTan}\ (S/(h-F))].$$

Figure 11:
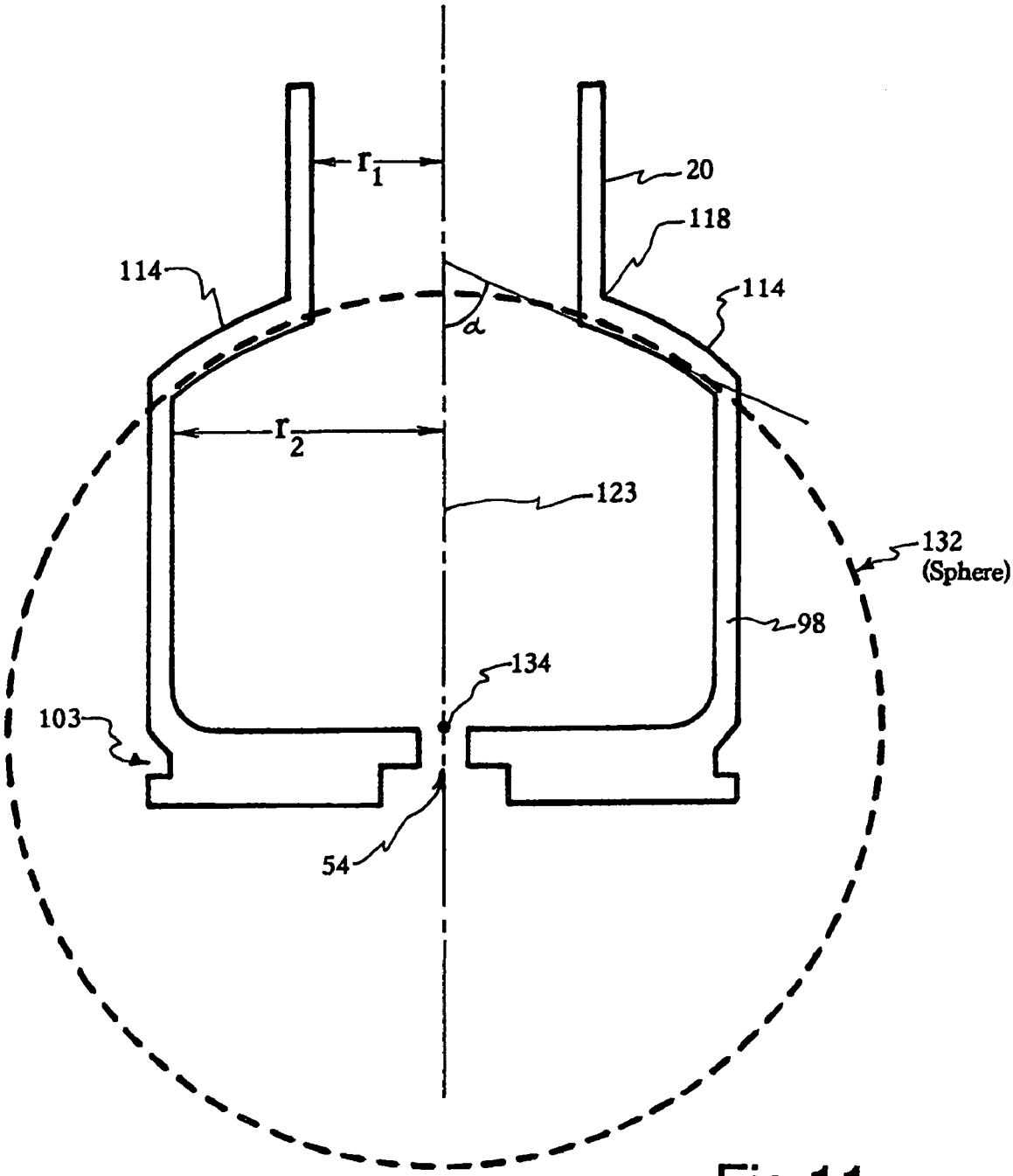
FIG. 11 is a cross-sectional view of an alternative embodiment of a cartridge of the present invention.

Referring to FIG. 11, a cross-sectional view of an alternative embodiment of the case 98 is shown to illustrate geometrical dimensions. In the embodiment shown, the shoulder 114 is spherical in that is defined by a sphere 132 (shown in phantom) that is centered along the longitudinal axis 123. If the difference between the major and minor axis of the ellipsoid 122 becomes zero or negative as a result of a small case capacity, the foci converge and the shoulder 114 may be spherical. A spherical shoulder 114 may also be desirable if is necessary to limit the degree of the focus zone 89 to prevent ignition from adiabatic heating of air from just below the bullet base 66.

As shown in FIG. 11, the sphere 132 has a center 134 and all points on the shoulder 114 are equidistant from the center 134. The center 134 may be disposed at the face of the flash hole 54. Shockwaves 82 are directed to the center 134 which serves as the approximate location of the focus zone 89. In the embodiment of FIG. 11, the sphere 132 configures to the shoulder 114 and touches the face of the flash hole 54 at its center. However, the sphere 132 may be configured in various ways to adjust the center 134. Thus, the sphere 132 need not necessarily contact the flash hole 54 and the center 134 may be moved closer or further from the bullet base 66.

Figure 12:
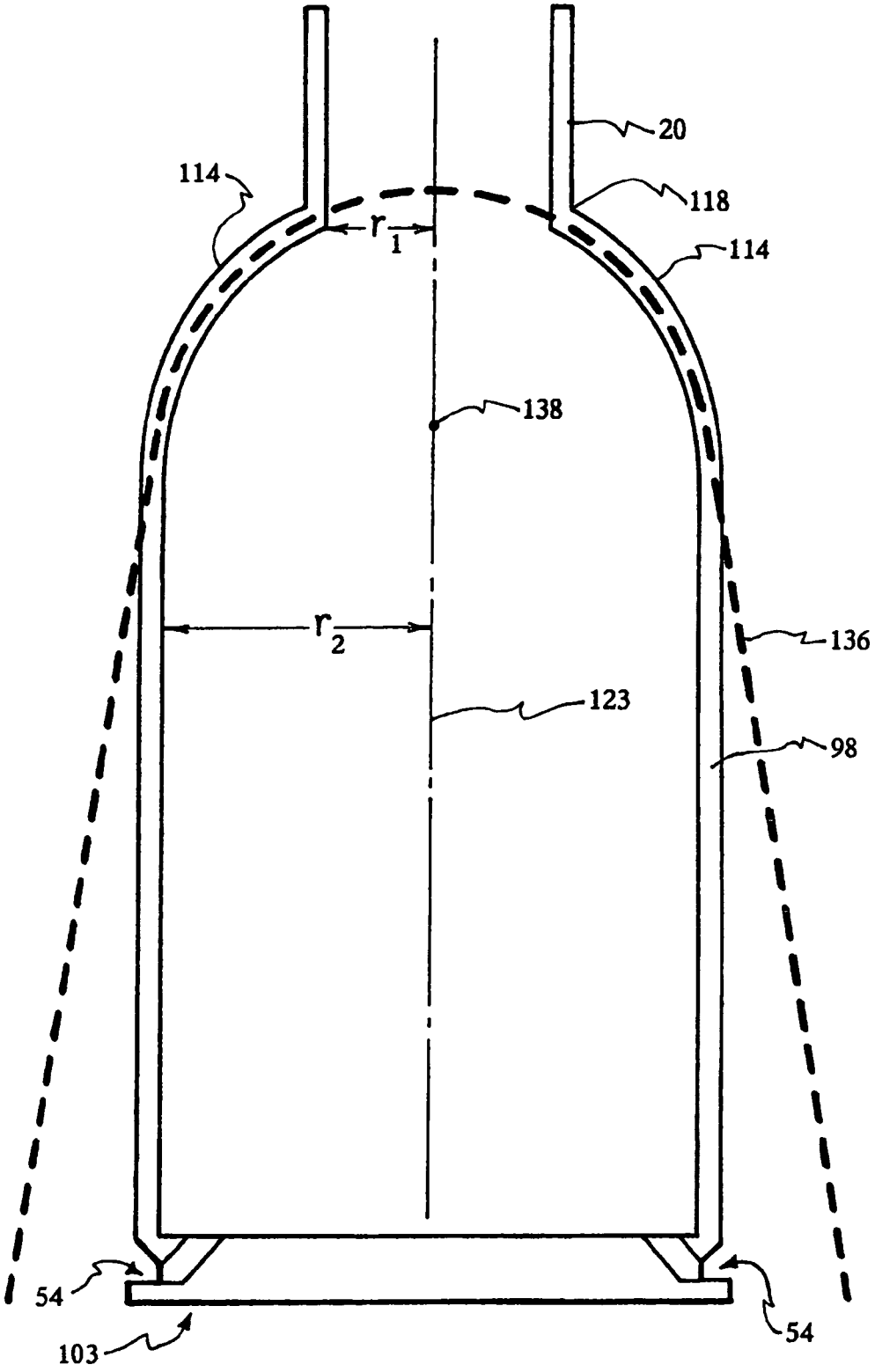
FIG. 12 is a cross-sectional view of an alternative embodiment of a cartridge of the present invention.

Referring to FIG. 12, a cross-sectional view of an alternative embodiment of the case 16 is shown. In the embodiment shown, the shoulder 114 is parabolic in that is defined by a paraboloid 136 (shown in phantom) that is centered along the longitudinal axis 123 and has a focus point 138. A parabolic shoulder 114 may be used for relatively long cases 16 where the foci of an ellipse diverge. Alternatively, the parabolic shoulder 114 is applicable when the primer charge is not centrally located as in some rimfire and Berdan-primed cartridge designs. Configured as a rimfire cartridge, the flash path 54 is located along a lower peripheral edge. As in the embodiments of FIGS. 10 and 11, the parabolic shoulder 114 focuses a shockwave at a focus zone 89 just far enough from the bullet base 66 to prevent conductive heat loss into the bullet 60. The focus point 138 may serve as the proximate location of the focus zone 89. Thus, the paraboloid 136 may be adjusted to provide shoulders 114 that focus the shockwaves 82 into the desired focus zone 89 location.

Figure 13:
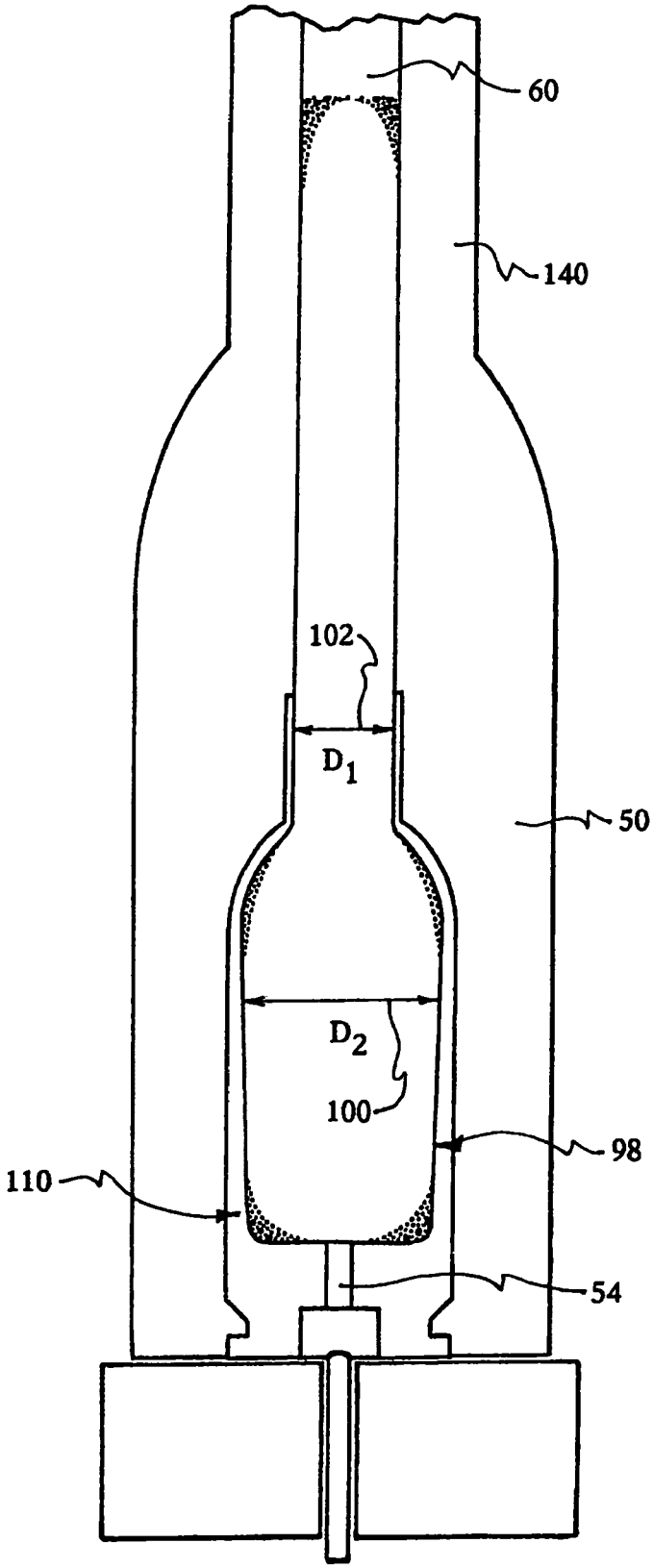
FIG. 13 is a cross-sectional view of a cartridge of the present invention disposed within a gun chamber.

Referring to FIG. 13, a cross-sectional view of a fat cartridge 110 in a chamber 50 is shown after combustion. The case 98 has an interior base diameter 100 that is approximately twice or more the interior neck diameter 102. The bullet 60 travels down the barrel 140 towards the muzzle. Propellant 56 in the plug 70 and in the propellant wall 104 adjacent the interior case surface 98 burn simultaneously and completely before the bullet 60 exits the muzzle. This is efficient as both the plug 70 and the propellant wall 104 contribute to the overall propulsion of the bullet 60.

Figure 14:
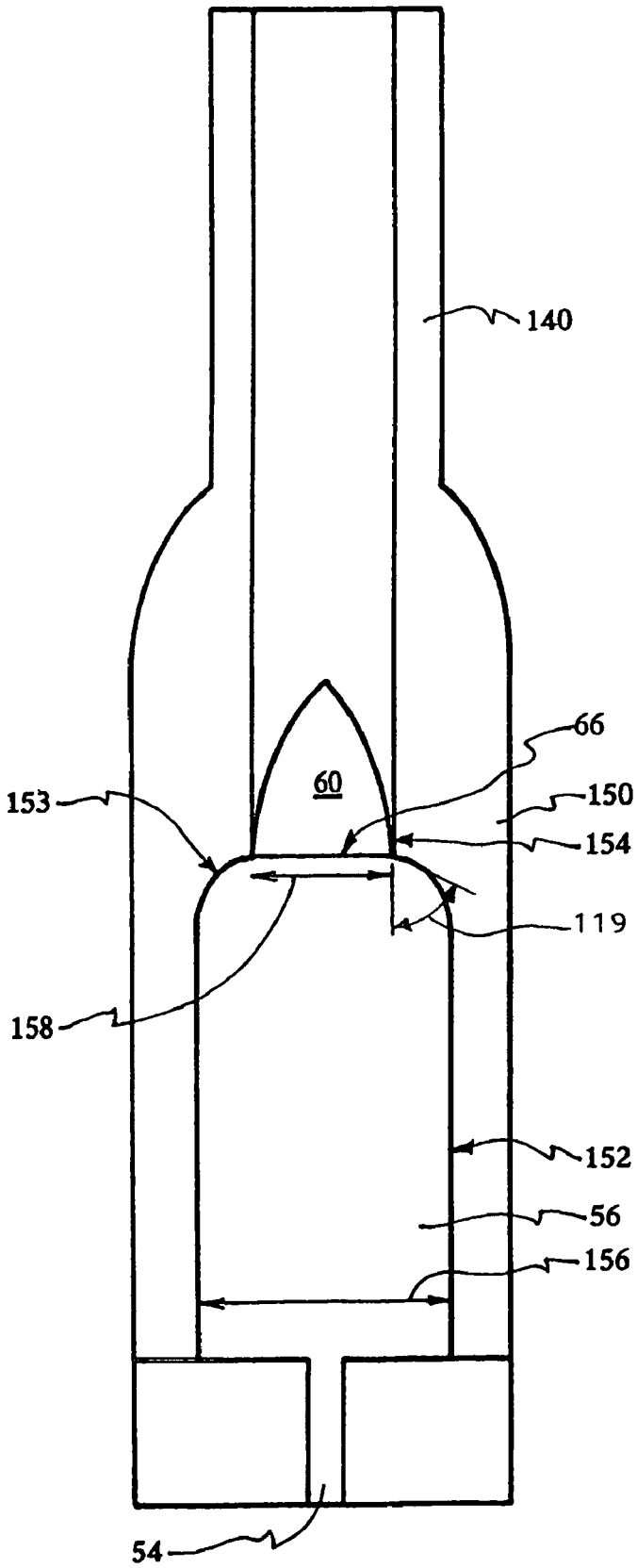
FIG. 14 is a cross-sectional view of one embodiment of a case-less gun chamber of the present invention.

Referring to FIG. 14, there is shown a case-less gun chamber 150 of the present invention. Although the discussion has been directed to cartridges, the present invention further includes case-less gun chambers. The chamber 150 may be configured with a base 152 and shoulder 153 for containing a propellant 56, and a neck 154 for containing the bullet 60. The bullet base 66 seats approximately at the juncture of the neck 154 and the shoulder 153.

The chamber 150 is similarly configured to the fat case 98 in that the base diameter 156 is approximately 1.8 to 2.3 times the size of the neck diameter 158. The shoulder 153 may further be defined by an ellipsoid, sphere, or paraboloid similar to FIGS. 10 to 12. Thus configured, the gun chamber 150 provides similar benefits in directing primer ignition shockwave, improving combustion efficiency, and reducing heat acceleration and losses. The shoulder 153 may also be frusto-conical. The shoulder 153 preferably has a shoulder angle 119 of approximately 40 degrees or more to facilitate propellant shear line formation.

Figure 15:
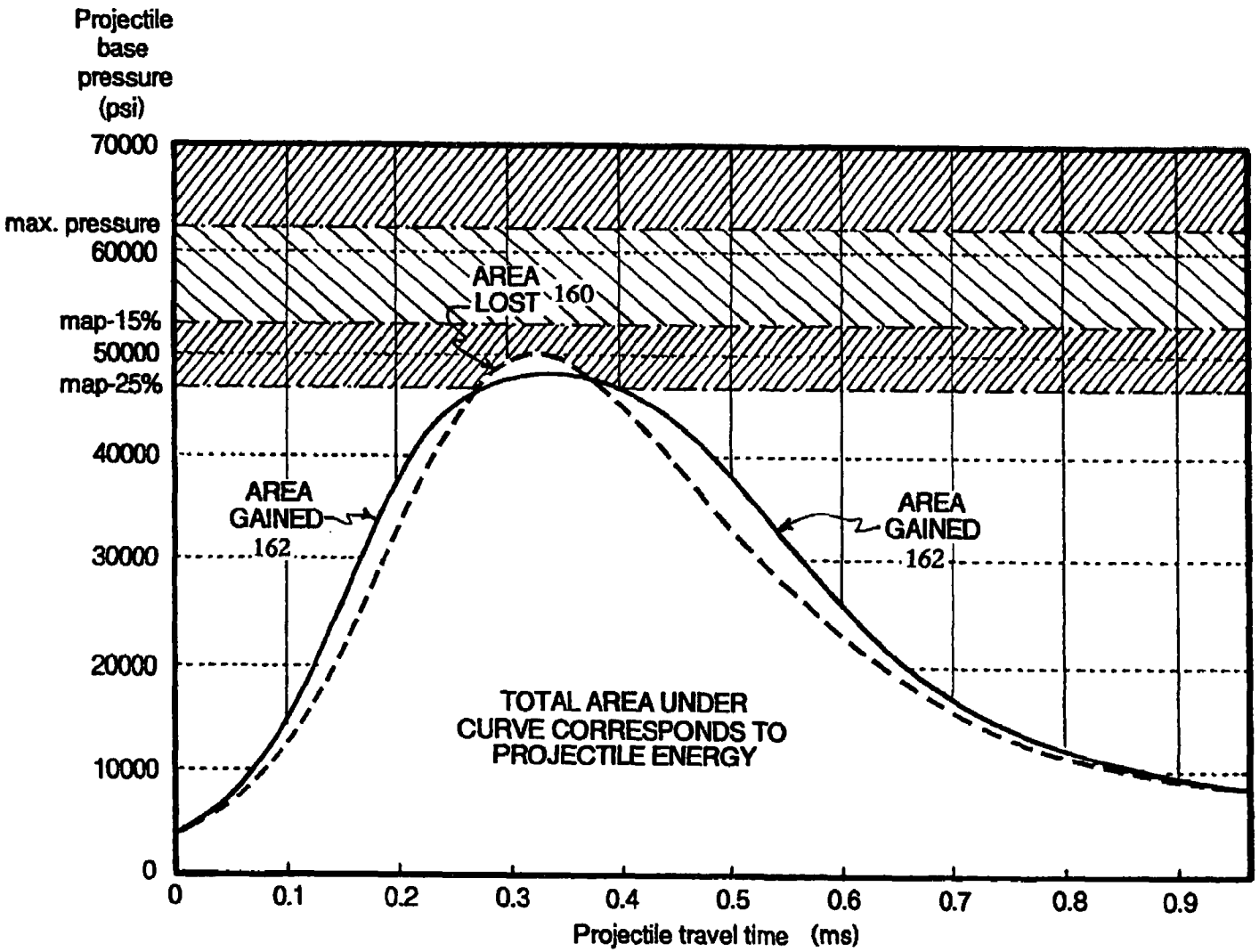
FIG. 15 is a graphical representation of pressure experienced by a projectile over time during the combustion process.

Referring to FIG. 15, a graphical representation of the total pressure increase experienced using fat cartridges 110 and case-less chambers 150 of the present invention. The projectile base pressure is shown on the y-axis and the projectile travel time is shown on the x-axis. The present invention experiences a loss 160 in maximum pressure. The graph charts the performance by a fat cartridge 110 of the present invention and a conventional cartridge having the same propellant capacity. However, the present invention provides gains 162 in pressure over conventional cartridges and does so over a longer period of time. Overall the present invention optimizes the pressure-time integral. The bullet 60 is able to achieve a given velocity sooner because pressure rises faster and remains close to peak for a longer time before dropping off.

Figure 16A:
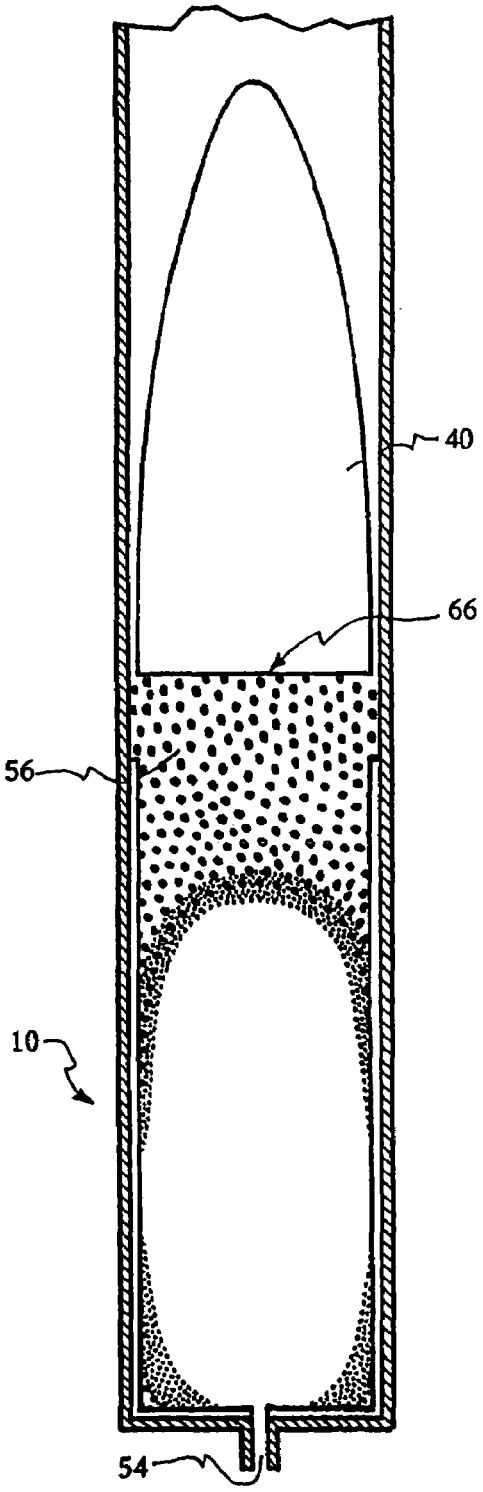
FIGS. 16A and 16B are cross-sectional views of straight-walled cartridges undergoing the combustion process.
Figure 16B:
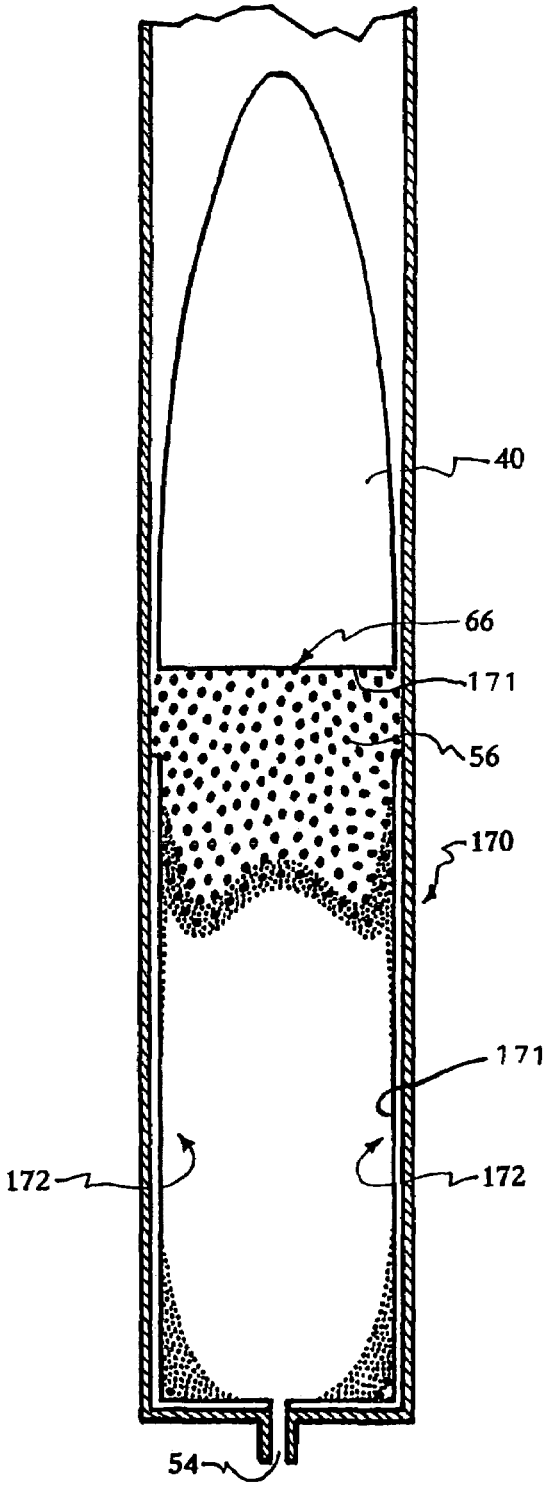

Referring to FIGS. 16A and 16B, cross sectional views of a conventional straight-walled cartridge 10 and an insulated straight-walled cartridge 170 are shown. Both cartridges 10, 170 are shown during the combustion process when the bullet 40 begins to move and the propellant 56 becomes a heterogeneous mass and reaches nearly full compression. The insulated straight-walled cartridge includes a reflective, thermally insulating coating 171 that is applied on a substantial portion of the interior case wall 172 and bullet base 66.

The coating 171 has a thermal breakdown temperature higher than the ignition temperature of the propellant. The coating advances the flame front by reflecting heat to aid ignition at the interior case wall 172 and accelerates the burning front along the case wall 172. The burning acceleration decreases the amount of propellant 56 pushed into the barrel behind the bullet 40. The burning acceleration increases chamber pressure and bullet velocity while reducing acceleration and heat losses in the barrel. The reflective insulation coating 171 also reduces heat losses to the case. With the conventional case 10, quenching along the interior case wall 172 is encouraged due to thermal conductivity of the case. With the insulated cartridge 170, the total area of combusting surface is greater than with the conventional cartridge 10 which improves combustion efficiency.

The reflective, insulating coating passively accelerates sidewall burn fronts at the interface between rapidly burning propellants and thermally conductive or endothermic inert surfaces, such as firearm cartridges and firearm chambers. The coatings utilize reflected infrared energy to accelerate burning at the propellant interface. The coatings, when exposed to infrared energy, reflect a portion of that energy back into the interface of the coating and propellant, heating the propellant to increase the local burn rate and thereby advance the burn front in that area.

Thus, a suitable reflective, insulation coating should not undergo thermal breakdown (i.e., burn) at a temperature below the propellant ignition temperature and should reflect heat (i.e., infrared radiation). By reflecting energy from the combustion gases onto the interface between the case wall and the propellant, the present invention is able to accelerate the burn front into that area while insulating the case wall to prevent quenching counteraction.

The reflective coatings may contain metal oxides as a reflective pigment in a suitable binder. Refractory metallic oxide pigments may be particularly preferred. Reflective coating pigments that may be used include, but are not limited to, lead oxide (white lead), titanium dioxide, zirconia (pigment grade), and aluminum oxide (paint grade). Reflective pigments may be present in the coating in an amount ranging from about 20% to about 60% by weight, preferably from about 25% to 50% by weight. Dense pigments, such as lead oxide, will likely have a higher weight percent than less dense pigments, such as aluminum oxide.

The coating binder should have a thermal break down temperature higher than the ignition temperature of the propellant or gun powder. Coatings which are endothermic at the ignition temperature of the propellant, approximately 340–380° F., operate in opposition to the flame front advancement, much the same as a conductive metal wall or casing. Reflective coatings which suffer no thermal break down below the ignition temperature of the propellant provide the desired flame front advancement. Among the coating binders providing suitable thermal stability are: high temperature epoxies, silicones, high temperature polyesters, high temperature thermoplastic, phenolic resins, high temperature polyurethanes, and polycyanurates.

All the above materials are commercially available; however, most high temperature coating formulations are generally considered proprietary by the manufactures.

The invention will be further described by reference to the following detailed examples. These examples are not meant to limit the scope of the invention that has been set forth in the foregoing description.

EXAMPLES

Experimental tests have demonstrated the existence of shear lines under certain conditions in gun cartridges. Calculation of the area of these shear lines has made it possible to predict peak chamber pressure and the pressure-time integral with better accuracy than has been previously possible.

Tests were performed with a variety of cartridges, commercial propellants, and primers utilizing an inert propellant simulant obtained from Nexplo division of Bofors Munitions in Sweden. Cartridge cases with internal lengths longer than one inch were loaded completely with the inert simulant then fired in a test gun. Bullet movement and the depth of primer residue penetration were measured. Then in subsequent tests the depth of inert simulant was reduced and live propellant was added in increments until ignition was achieved as evidenced by dramatic increase in bullet movement and consumption of the live propellant. In all cases ignition occurred between 0.5 and 0.6 inches depth of inert simulant after correction for propellant compression. This led to the conclusion that complete ignition by the primer occurs in cartridges with internal lengths of 0.6 inches or less. It was also noted that more powerful primers such as magnum rifle type often did not cause ignition to as great a depth as small rifle or pistol primers.

The cause of this phenomenon is believed to be that compression of the propellant granules from primer pressurization closes off the interstitial air gaps, preventing ignition gases from deeper penetration. This compression also causes adiabatic heating of the included gas, preparing the adjacent granules for later ignition. Focusing the ignition shock waves to a point behind the bullet with certain shoulder configurations as disclosed herein concentrates heating in a manner that minimizes heat loss to the bullet base whereas frusto-conical shoulders spread heating throughout the case and may cause early bullet movement.

It has been noted through testing that no advantage stemming from the short fat (approximately 2 to 1 or more internal case to bullet diameter ratio) case exists in cases with internal lengths less than about 0.6 inches. This would be expected if all propellants were ignited by the primer. Therefore, the advantages of the present invention are realized with cartridges having internal lengths greater than about 0.6 inches. This excludes most pistol and handgun cartridges. Longer cases require slower burning propellants in proportion to additional shear line areas whereas cases with short internal lengths may utilize propellants with burning rates proportional to barrel length for best efficiency.

Figure 18:
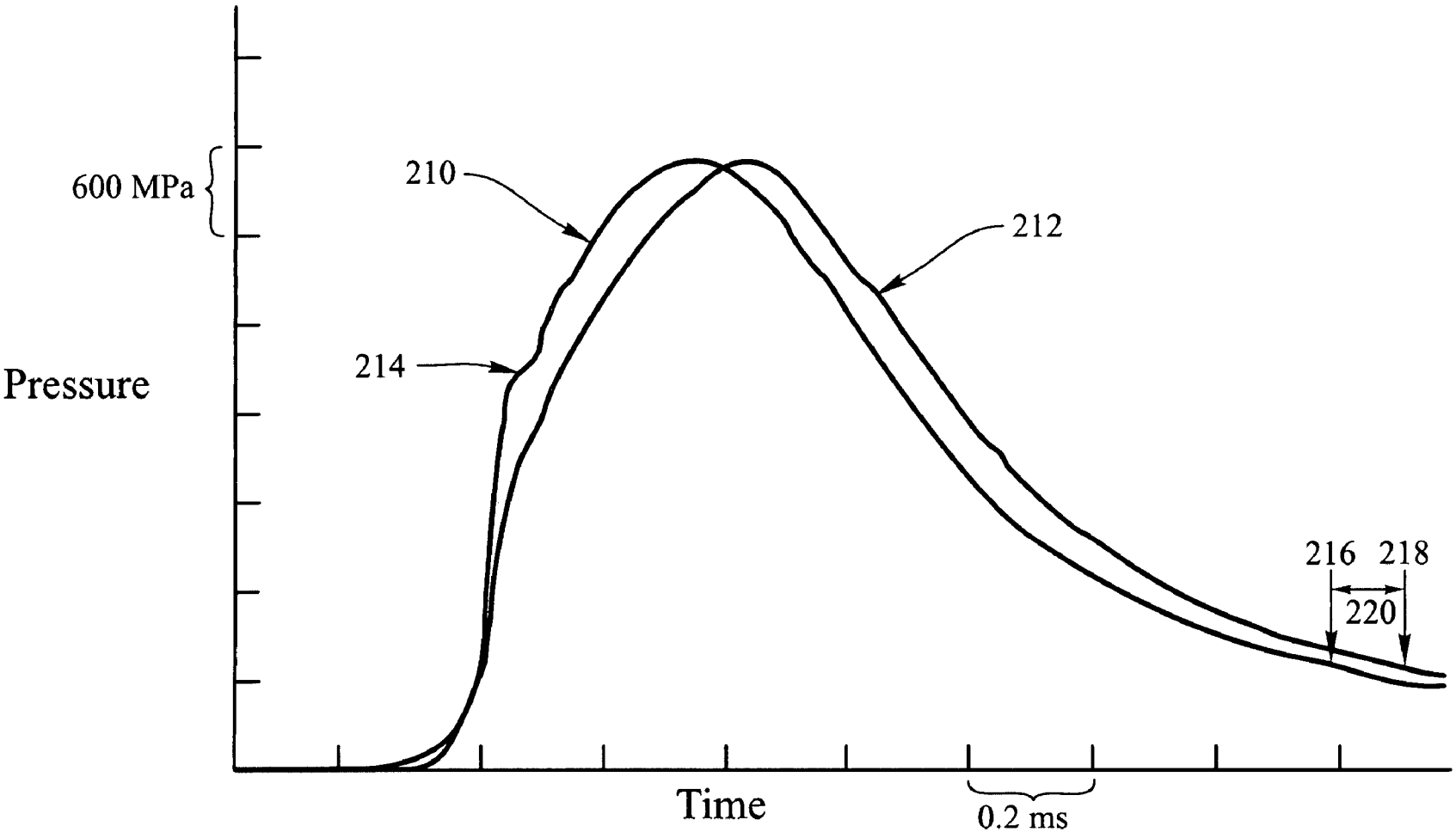
FIG. 18 is a graphical representation of piezoelectric pressure time curves comparing cartridges.

Cartridges having internal diameters of approximately 2 or more times the bullet diameter, internal lengths more than about 0.6 inches, and shoulder angles of about 40 degrees or more cause formation of an internal shear line, as noted from piezoelectric pressure curves, such as the curve shown in FIG. 18. The shear line is formed in the compressed propellant behind the bullet as the bullet is pushed into the barrel. It is roughly bullet diameter and has initial length approximately equal to the total internal length minus 0.5 to 0.6 inches.

In FIG. 18, curve 210 was generated using a 6.5 mm cartridge, 60 grain capacity, with an elliptical shoulder configuration, designated as a 6.5/60 $SM^C$ cartridge. Curve 212 was generated using a commercially available 6.5-284 Winchester cartridge. The 6.5-284 Winchester cartridge has a 35 degree frusto-conical shoulder, the 6.5/60 $SM^C$ has an elliptical shoulder ending at an angle of 50.5 degrees at the neck-shoulder junction. The inflection point 214 in the pressure rise of the curve 210 indicates shear line formation.

By equalizing the area under the respective pressure vs. time curves, it is possible to use a barrel length with the 6.5/60 $SM^C$ cartridge about 5 inches shorter than the barrel used with the 6.5-284 Winchester cartridge to obtain the same velocity. This is done by equalizing the muzzle pressure on the two curves. In FIG. 18, the points of equal muzzle pressure for are identified by arrows 216 and 218. Arrow 216 corresponds to curve 210 and arrow 218 corresponds to curve 218. The time difference 220 between the two equal pressures is measured and found to be about 0.0001 sec. Multiplying the time difference by the muzzle velocity gives the muzzle length difference. With a muzzle velocity of 4000 ft/sec, the difference in muzzle length is calculated as follows:

$$(4000\ \text{ft/sec})(12\ \text{in/ft})(0.0001\ \text{sec})=4.8\ \text{inches}\sim 5\ \text{inches}$$

The shear line is easily formed at first bullet movement because smokeless gun propellants have enormous compressive strength at high loading rates but being granular (spherical, tubular or flake) have, like sand, very little shear strength. Use of this information makes it possible to design highly efficient cartridges when combined with the technology disclosed in the U.S. Pat. No. 6,523,475. Testing has been performed over a range of angles from 40 to 60 degrees at the neck-shoulder junction and internal lengths from 0.5 to 2.7 inches.

Performance of several $SM^C$ (trademark) cartridges is presented below along with associated gun data. Note that cartridge volume in grains of water to the neck-shoulder junction is denoted by the second number, i.e. 6/55 $SM^C$ denotes a case capacity of 55 grains of water when bullet is properly seated at the neck-shoulder junction.

| 22/40 $SM^C$ (Case capacity equal to 22-250, about 6 grains less than 220 Swift) | | | | | | |
|---|---|---|---|---|---|---|
| Bullet | Wt. gr. | Propellant | Wt. gr. | V, ft/sec | SD | Pres., psi |
| Nosler BT | 40 | H-335 | 42 | 4655 | 23 | about 60K |
| Sierra | 55 | H-414 | 46.5 | 4172 | 27 | about 60K |
| Sierra | 69 | H-4350 | 42.5 | 3889 | 47 | about 65K |
| Sierra | 80 | H-4350 | 41 | 3471 | NA | about 55K |

Gun, Savage BVSS, 25 in. barrel, 1 turn in 9 inches twist. Cartridge, 43 gr. cap., 52 degree angle at neck shoulder junction, 2.08 ratio (interior body diameter to interior neck diameter), 0.565 inch shear line length. The shear line is short as is the propellant plug following the bullet, therefore the peak pressures are low and efficiency is high.

| 6 mm/55 SM$^C$ (case capacity about 6 grains less than the 6 mm–284 Win.) | | | | | | |
|---|---|---|---|---|---|---|
| Bullet | Wt. gr. | Propellant | Wt. gr. | V, ft/sec | SD | Pres., psi |
| Nosler | 95 | N-165 | 55 | 3631 | NA | about 65K |
| Lapua | 105 | Reloader 25 | 58 | 3647 | 32 | about 65K |
| Sierra | 107 | Reloader 25 | 58.5 | 3675 | 19 | about 65K |
| Berger | 115 | N-170 | 58.5 | 3555 | 23 | about 65K |

Gun, Savage SS, 29 inch Krieger barrel, 1 turn in 9 inches twist, high pressures between 65000 and 67000 psi. Cartridge, 59 gr. cap., 52.5 degree angle at neck shoulder junction, 2.06 ratio (interior body diameter to interior neck diameter), 0.723 inch shear length.

| 6.5 mm/60 SM$^C$ (case capacity approximately 4 grains less than 6.5 mm–284 Win.) | | | | | | |
|---|---|---|---|---|---|---|
| Bullet | Wt. gr. | Propellant | Wt. gr. | V, ft/sec | SD | Pres., psi |
| Norma | 130 | H-4350SC | 58.5 | 3414 | 15 | about 65K |

Gun, Savage SS, 28 inch Pac-Nor barrel, 1 turn in 8 inches twist, high pressure in excess of 65000 psi. Cartridge, 62 gr. cap., 50.5 degree angle at neck shoulder junction, 2.10 ratio (interior body diameter to interior neck diameter), 0.683 inch shear length.

| 6.5 mm/60 SM$^C$ (case capacity approximately 4 grains less than 6.5 mm–284 Win.) | | | | | | |
|---|---|---|---|---|---|---|
| Bullet | Wt. gr. | Propellant | Wt. gr. | V, ft/sec | SD | Pres., psi |
| Berger VLD | 140 | H-4831SC | 56.5 | 3022 | 11 | about 60K |

Gun, Savage, SS 24 inch Pac-Nor barrel, 1 turn in 8.5 inches twist. Cartridge, same as above.

The measured velocities are higher with lower propellant loads than any recorded in the literature by as much as 14% and as little as 6%. Thus it is concluded that design of cartridges utilizing a ratio of internal body diameter to bullet diameter of approximately 2 to 1 is an aid to ballistic efficiency in combination with a shoulder configuration that facilitates shear line formation.

A shear line is developed within the cartridge at first bullet movement when the angle at the neck-shoulder junction is greater than approximately 40 degrees. Ignition of that shear line adds additional burning surface which in turn defines peak pressure in the cartridge. Use of this shear line as a device to control peak pressure in the cartridge is also an advance in the state of the art. Use of the generated shear line areas to predict gun cartridge peak pressures and other aspects of cartridge performance has not been previously disclosed or utilized. This is therefore considered an advancement of the state of the art.

In addition, utilization of the shear line to control peak pressure while using the case diameter, over the range of ratios of 1.8 to 2.3, to control internal volume, provides additional flexibility for the cartridge designer. For example, if the cartridge designer wishes to lower peak pressure and keep the same cartridge volume, the case diameter may be increased and the case length may be decreased. Similarly, if the cartridge designer wishes to increase peak pressure and keep the same cartridge volume, the case diameter may be decreased and the case length may be increased.

Cartridges which have internal lengths measured from flash hole to bullet base less than 0.6 inches plus the measured propellant compression, in general do not have a discernable shear line formed behind the bullet because nearly all propellant is ignited by the primer. Thus, the short pistol cartridge configurations described by Alexander, U.S. Pat. No. 6,293,203 B1 would not form a shear line. Most pistol propellants have compressions in excess of 20% at first bullet movement. Only propellant in contact with the brass case is excluded from ignition because the high thermal conductivity of brass (up to 400 times higher than nitrocellulose) would quench propellant ignition. That propellant is either consumed by turbulence in the barrel or exits the muzzle unignited.

Cartridges which are longer but have a shoulder angle less than 35 degrees (Jamison U.S. Pat. Nos. 5,970,879, 6,550,174, and 6,595,138) or double radiused shoulders (Weatherby) do not have a well defined shear line as the shoulder angle is insufficient to trap the propellant in the cartridge case. A substantial portion of the sheared propellant follows the propellant plug down the barrel. In longer cases with mild shoulder angles, all propellant not initially ignited may follow the bullet down the barrel as is the case with straight walled cases.

As the cartridge becomes fatter and the shoulder angle is made steeper, greater than approximately 40 degrees, the shear line acting at the bullet diameter becomes more pronounced between the propellant plug pushing the bullet and the propellant trapped by the shoulder. This sheared surface ignites more quickly than the normal propellant burn rate as previously described. The double burning surface area of the sheared surface adds greatly to the pressure being generated and can be added to the semispherical burning surface originally ignited by the primer to determine peak pressure. Peak pressure is achieved when total area reaches a maximum, early in bullet movement into the barrel. The use of this additional surface area to explain the pressure-time curve in gun cartridges has not previously been postulated or disclosed.

Previous techniques used progressivity, regressivity, and progressivity-regressivity rollover coefficients for each propellant to explain the burn front progression. Naturally these coefficients are cartridge specific and not usable for any cartridge except the one for which the coefficients were generated. Performance predictions based on these coefficients for new cartridges are, in general, not acceptably accurate.

Utilizing the additional double burning area defined by the shear line caused by bullet movement makes a reasonable prediction of peak pressure possible. In fact iterative solution of the equations given below make it possible to calculate the entire pressure time curve for any cartridge of length greater than about 0.6 inches and shoulder angle greater than approximately 40 degrees. Propellant burn rates in the cartridge can be predicted from the classic solid rocket burn rate equation:

$$R_c = R_s\left(\frac{P_c}{P_s}\right)^N$$

Where $R_c$ is the propellant burn rate at pressure in chamber;

$R_s$ is propellant burn rate at the known pressure;

$P_c$ is the chamber pressure;

$P_s$ is the known pressure; and

N is the burn rate exponent over the range of pressures being considered. It is less than one and typically ~0.2 to 0.9.

The propellant plug of bullet diameter, which is sheared from the body of propellant in the combustion chamber as the bullet begins to move, burns at a reduced rate caused by bullet acceleration. The local pressure on the plug is reduced by the dynamic pressure defined as:

$$\frac{\rho V^2}{2g}$$

Where

ρ is the combustion gas density;

V is the velocity of the bullet; and g is the gravitational constant.

As the propellant plug accelerates down the barrel, the burn rate of the propellant plug will decrease further with the local pressure drop as a function of bullet acceleration. Therefore the diameter of the chamber body must be increased with longer barrels. A reasonable length of barrel and bullet weight would define the ratio of the chamber internal diameter to bullet diameter up to about 2.3. Longer barrels and lighter bullets could use more chamber internal diameter, shorter barrels and heavier bullets might use a smaller ratio but never less than about 1.8. For most applications, the ratio of internal chamber diameter to internal neck diameter will range from about 2.0 to about 2.2. Burn rate of the propellant must be matched to the bullet weight to preclude excessive peak pressure.

An internal cartridge length greater than 0.6 inches is required to provide a shear zone at the interface of the compressed propellant column. Testing has shown that initial compression of the powder before bullet movement may be 10 to 19% depending upon the powder type. The length of that volume is added to the plume penetration depth. As the bullet begins to move, a shear area of bullet diameter develops in the propellant column in any length excess of the above stated depth. The ignition area of this shear zone is equal to twice the surface area as it burns both inwardly and outwardly less the amount of area quenched by the brass (or metal) neck and throat due to bullet movement. This additional burn area adds to the peak pressure. Longer cartridges will produce higher peak pressure, shorter cartridges will produce less peak pressure due to the longer shear zone, other parameters being equal.

Initial burning surface area is calculated by:

$$A=T[4\pi D^2/4] \quad (1)$$

Then when bullet movement occurs, the burning surface area is calculated by:

$$A=T([2\pi D^2/4]+2\pi d_O[l_O-l_{OC}]+2\pi n\ d_1[l_I-l_{IC}-m_b])$$

Where

A is burn area at time t;

T is a "texture" term defining the width of the burn front and a constant for each propellant type. It is always greater than unity and is controlled by granule configuration, inhibition layer, etc.;

D is internal diameter of the brass case;

$d_O$ is diameter of the outer shear line;

$d_I$ is diameter of the inner shear line;

$l_O$ is length of outer shear line;

$l_{OC}$ is compression factor for the propellant at outer shear line;

$l_I$ is length of inner shear line. This term disappears when the bullet movement exceeds the inner shear line length;

$l_{IC}$ is compression factor for the propellant at inner shear line; and $m_b$ is bullet movement at time t.

Figure 19A:
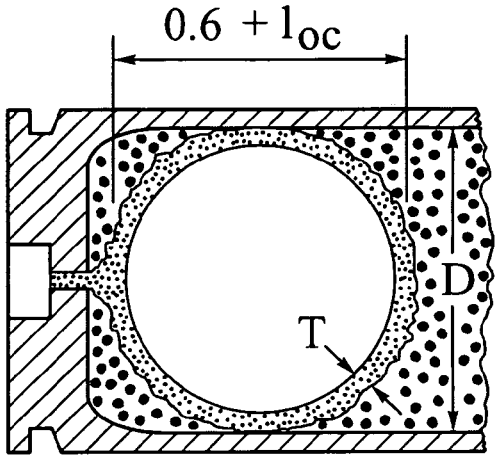
FIGS. 19A and 19B are cross-sectional views of a cartridge showing burn fronts before and after shear line formation as the bullet begins to move.
Figure 19B:
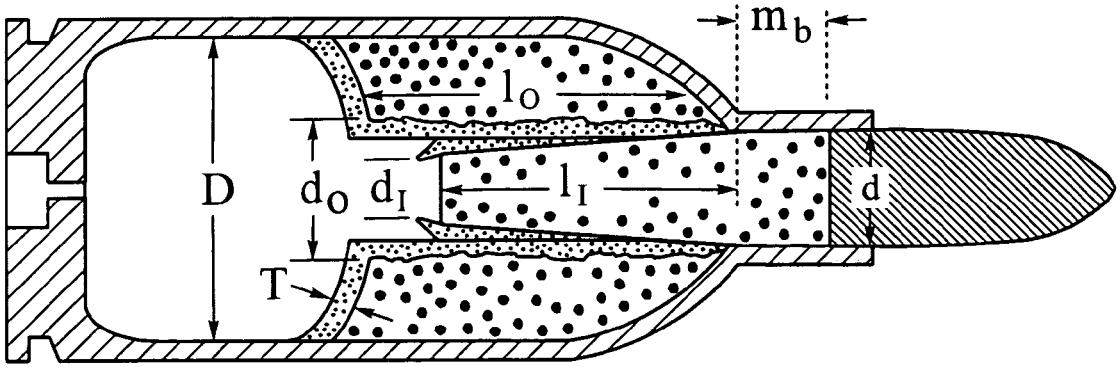

FIG. 19A is a cross-sectional view of a cartridge illustrating the parameters for equation (1). FIG. 19B is a cross-sectional view of a cartridge illustrating the parameters for equation (2).

Peak pressure is reached when the burning surface area reaches a maximum in the cartridge, keeping in mind that the plug of propellant following the bullet can only burn from the chamber side because of the quenching action of the barrel or metal case neck.

Use of this burn front model for parametric cartridge design has maximized cartridge performance and efficiency beyond any heretofore achieved. This was done by setting D between about 1.8 and 2.3 times bullet diameter and length "1" to more than 0.6 inches plus the compression factor for the propellant. An internal ellipsoidal shoulder angle of 48 to 54 degrees at the neck shoulder juncture was provided, focusing the primer shock wave 0.04 to 0.10 inches from the bullet base to minimize heat loss to the bullet. This maximizes adiabatic heating of the propellant that would normally be the last to burn before the bullet reaches the muzzle.

The present invention provides an approximately two to one or greater ratio of body diameter to bullet diameter of bottlenecked cases to optimize combustion efficiency. In addition, the invention provides a steep shoulder angle to facilitate formation of a propellant shear line which optimizes the pressure vs. time curve. The increased diameter creates a greater primary ignition zone and reduces heat loss by having a thicker layer of propellant on the interior case surface until burnout. The present invention further reduces acceleration loss by reducing the length of the propellant plug. The present invention further provides simultaneous burn in the propellant plug and propellant wall to reduce inefficiency and waste. The present invention provides more burning of the propellant in the neck and case interior rather than within the barrel. Reduced propellant burning in the barrel reduces erosive damage to the throat and leade areas. The present invention allows shorter barrel lengths because ignition and burning is more rapid in the large diameter case. Shorter barrels generally improve accuracy of the firearm because they increase the natural frequency of the firearm thereby reducing the amplitude of vibration of the firearm. Also, shorter barrels result in a lighter firearm. The cartridge may be configured to focus a shockwave just far enough from the bullet base to reduce heat loss to the bullet and support bullet retention in the neck for a longer period of time. Greater flexibility in cartridge design is possible because the shear area may be adjusted to control peak pressure while cartridge internal volume may be adjusted by changing the ratio of internal diameter ratios over the range of 1.8 to 2.3 times the bullet diameter.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention.

The invention claimed is:

1. A gun chamber for firing a case-less projectile, comprising:

a base;

a relatively straight-walled body portion extending from the base defining a generally cylindrical body cavity having a body diameter;

a shoulder portion connected to the relatively straight-walled body portion at a body-to-shoulder junction;

a neck portion defining a neck cavity and having a neck diameter which defines a ratio of the body diameter to the neck diameter which is in the range from about 1.8:1 to 2.3:1, wherein the neck diameter is sized to accommodate a case-less projectile at least partially nested therein, wherein the chamber is sized and configured to contain a sufficient quantity of propellant such that igniting the propellant causes formation of a propellant plug having a diameter that is approximately the interior neck diameter, and wherein the shoulder is connected to the neck at an angle of approximately 40 degrees or more which causes the propellant plug to shear free from unburned propellant that is disposed adjacent the relatively straight-walled body portion.

2. The gun chamber according to claim 1, wherein the relatively straight-walled body portion has a slightly tapered shape, being larger near the base.

3. The gun chamber according to claim 1, wherein the relatively straight-walled body portion has cylindrical shape.

4. The gun chamber according to claim 1, wherein the ratio of the body diameter to the neck diameter is in the range from about 2:1 to 2.2:1.

* * * * *

UNITED STATES PATENT AND TRADEMARK OFFICE

CERTIFICATE OF CORRECTION

PATENT NO. : 7,210,260 B1
APPLICATION NO. : 11/416147
DATED : May 1, 2007
INVENTOR(S) : Robert B. Smalley, Jr. et al.

It is certified that error appears in the above-identified patent and that said Letters Patent is hereby corrected as shown below:

In column 10, line 39, please delete "$\gamma$-$\alpha$=+$\alpha$" and replace it with --$\gamma$-$\alpha$=$\beta$+$\alpha$--.

In column 10, line 40, please delete "$\gamma$-=2$\alpha$" and replace it with --$\gamma$-$\beta$=2$\alpha$--.

In column 10, line 41, please delete "$\alpha$=($\gamma$-)/2" and replace it with --$\alpha$=($\gamma$-$\beta$)/2--.

Signed and Sealed this

Eighteenth Day of September, 2007

JON W. DUDAS
*Director of the United States Patent and Trademark Office*